US010599088B2

(12) United States Patent
Matsuno et al.

(10) Patent No.: US 10,599,088 B2
(45) Date of Patent: Mar. 24, 2020

(54) SHEET PROCESSING APPARATUS

(71) Applicant: CANON FINETECH NISCA INC., Misato-shi (JP)

(72) Inventors: Kenichi Matsuno, Minamikoma-gun (JP); Kazunori Endo, Minamikoma-gun (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/428,253

(22) Filed: Feb. 9, 2017

(65) Prior Publication Data

US 2017/0242388 A1 Aug. 24, 2017

(30) Foreign Application Priority Data

Feb. 22, 2016 (JP) ..... 2016-030757

(51) Int. Cl.
*B65H 31/38* (2006.01)
*B65H 45/18* (2006.01)
(Continued)

(52) U.S. Cl.
CPC ..... *G03G 15/6529* (2013.01); *B65H 29/52* (2013.01); *B65H 31/02* (2013.01);
(Continued)

(58) Field of Classification Search
CPC ..... B65H 31/38
See application file for complete search history.

(56) References Cited

U.S. PATENT DOCUMENTS 7,431,683 B2 10/2008 Takemoto et al.
8,141,861 B2 3/2012 Kamiya
(Continued)

FOREIGN PATENT DOCUMENTS

| | | | |
|---|---|---|---|
| JP | 2007-145511 | A | 6/2007 |
| JP | 2008-184324 | A | 8/2008 |
| JP | 2010-030698 | A | 2/2010 |
| JP | 2010-037110 | A | 2/2010 |
| JP | 2012-030975 | A | 2/2012 |
| JP | 2007-145511 | A | 6/2017 |

OTHER PUBLICATIONS

U.S. Appl. No. 15/348,007, filed Nov. 10, 2016, first named inventor: Kazunori Endo.
(Continued)

*Primary Examiner* — Jennifer E Simmons
(74) *Attorney, Agent, or Firm* — Venable LLP

(57) ABSTRACT

Provided is a sheet processing apparatus, including: a regulation portion configured to contact with an end edge of a sheet to be conveyed and to regulate a position of the sheet; a position adjustment portion configured to perform position adjustment on a sheet in a direction along an end edge of the sheet of which the end edge is in contact with the regulation portion; a folding portion configured to perform folding processing on a sheet which has been regulated by the regulation portion; and a control portion configured to execute: a first mode of causing the folding portion to perform the folding processing on a sheet which has been regulated by the regulation portion, without causing the position adjustment portion to perform the position adjustment on the sheet; and a second mode of causing the position adjustment portion to perform the position adjustment with respect to the regulated sheet.

7 Claims, 19 Drawing Sheets

(51) Int. Cl.

| | |
|---|---|
| ***G03G 15/00*** | (2006.01) |
| ***B65H 31/02*** | (2006.01) |
| ***B65H 31/36*** | (2006.01) |
| ***B65H 31/20*** | (2006.01) |
| ***B65H 29/52*** | (2006.01) |

(52) U.S. Cl.

CPC ..... *B65H 31/20* (2013.01); *B65H 31/36* (2013.01); *B65H 31/38* (2013.01); *B65H 45/18* (2013.01); *B65H 2301/4213* (2013.01); *B65H 2301/42146* (2013.01); *B65H 2403/946* (2013.01); *B65H 2404/1114* (2013.01); *B65H 2404/5311* (2013.01); *B65H 2404/63* (2013.01); *B65H 2405/211* (2013.01); *B65H 2405/214* (2013.01); *B65H 2511/10* (2013.01); *B65H 2511/30* (2013.01); *B65H 2801/27* (2013.01); *G03G 15/6541* (2013.01); *G03G 15/6582* (2013.01); *G03G 2215/00877* (2013.01)

(56) References Cited

U.S. PATENT DOCUMENTS

| | | | | |
|---|---|---|---|---|
| 2010/0117284 | A1 | 5/2010 | Taguchi | |
| 2013/0049278 | A1* | 2/2013 | Tsuchiya | B65H 45/18 270/45 |
| 2016/0031236 | A1* | 2/2016 | Itogawa | B41J 13/0036 270/1.01 |

OTHER PUBLICATIONS

U.S. Appl. No. 15/348,036, filed Nov. 10, 2016, first named inventor: Kazunori Endo.

Office Action dated May 17, 2018, in Japanese Patent Application No. 2016-030757.

Office Action dated Nov. 16, 2018, in Japanese Patent Application No. 2016-030757.

* cited by examiner

SHEET PROCESSING APPARATUS

BACKGROUND OF THE INVENTION

Field of the Invention

The present invention relates to a sheet processing apparatus configured to perform folding processing on, for example, a sheet or a bundle of sheets delivered from an image forming apparatus.

Description of the Related Art

Hitherto, as post-processing for sheets delivered from image forming apparatus such as a copying machine, a printer, a facsimile, and a multifunction peripheral of those, there has been known processing of folding sheets to form a booklet.

As a sheet processing apparatus configured to perform folding processing, there has been known an apparatus configured to temporarily collect conveyed sheets in a substantially vertical state on a stacker portion by regulating leading edges of the sheets, and then perform center-folding on the collected sheets or bundle of sheets at a predetermined folding processing position (for example, see Japanese Patent Application Laid-Open No. 2010-37110).

The above-mentioned sheet processing apparatus is configured to push, through use of a pressing member, a bundle of sheets collected on the stacker portion to a nip position of a pair of folding rollers from a direction intersecting a conveyance direction, to thereby perform folding processing on the bundle of sheets through rotation of the folding rollers.

SUMMARY OF THE INVENTION

The present invention has been made in view of problems of the related art, and has an object to improve productivity or processing accuracy of a sheet processing apparatus.

According to one embodiment of the present invention, there is provided a sheet processing apparatus, including: a regulation portion configured to contact with an end edge of a sheet to be conveyed and to regulate a position of the sheet; a position adjustment portion configured to perform position adjustment on a sheet in a direction along an end edge of the sheet of which the end edge is in contact with the regulation portion; a folding unit configured to perform folding processing on a sheet which has been regulated by the regulation portion; and a control portion configured to execute: a first mode of causing the folding portion to perform the folding processing on a sheet which has been regulated by the regulation portion, without causing the position adjustment portion to perform the position adjustment on the sheet; and a second mode of causing the position adjustment portion to perform the position adjustment on a sheet which has been regulated by the regulation portion.

According to the present invention, it is possible to improve the productivity or the processing accuracy of the sheet processing apparatus.

Further features of the present invention will become apparent from the following description of exemplary embodiments with reference to the attached drawings.

DESCRIPTION OF THE EMBODIMENTS

Figure 1:
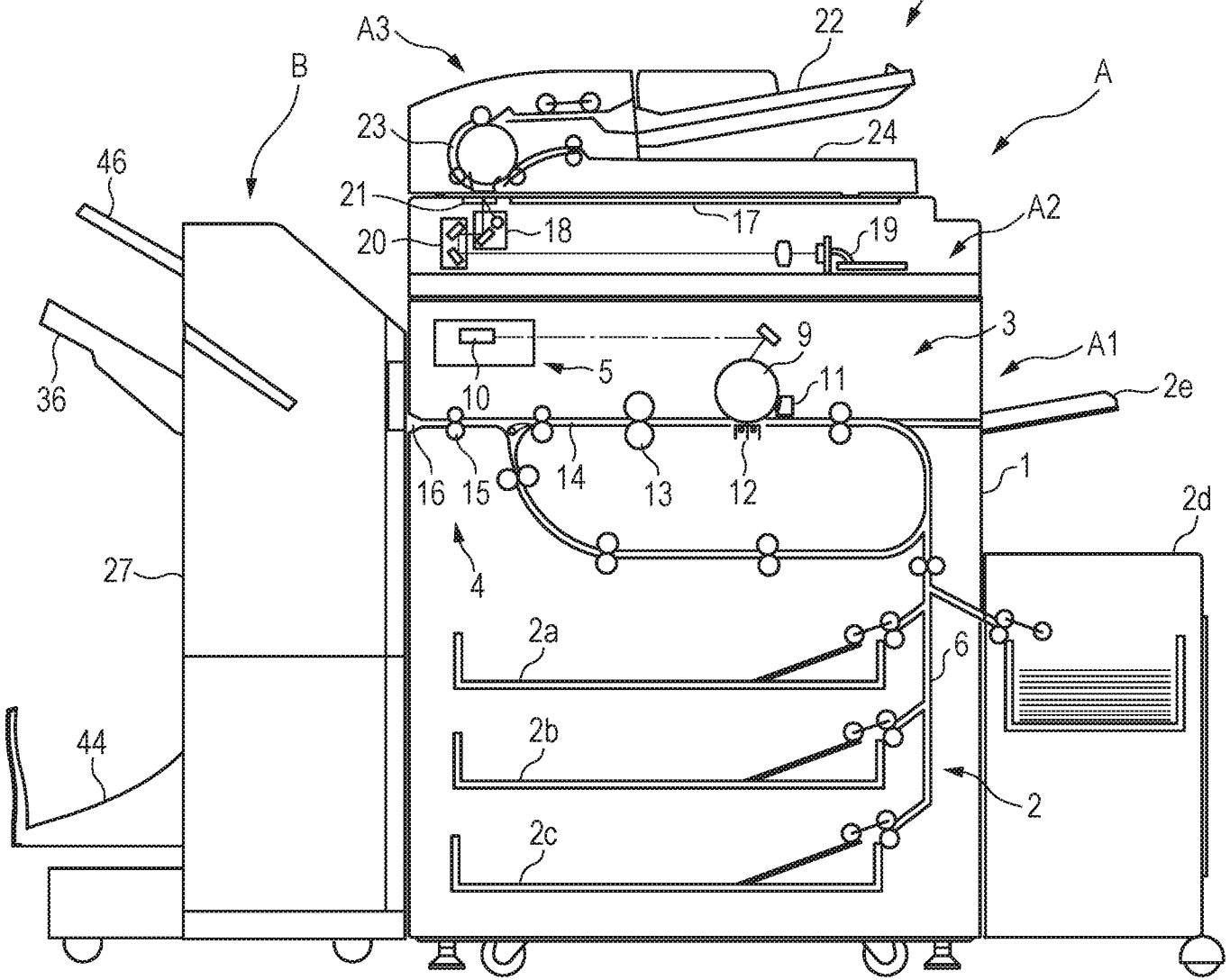
FIG. 1 is an explanatory view for illustrating an overall configuration of an image forming system according to a first embodiment of the present invention.

Now, with reference to the attached drawings, exemplary embodiments of the present invention are described in detail. FIG. 1 is a view for schematically illustrating an overall configuration of an image forming system including a sheet processing apparatus according to a first embodiment of the present invention.

As illustrated in FIG. 1, an image forming system 1000 includes an image forming apparatus A and a sheet processing apparatus B which is juxtaposed to the image forming apparatus A. The image forming apparatus A includes an image forming unit A1, a scanner unit A2, and a feeder unit A3. The image forming unit A1 includes a sheet feeding portion 2, an image printing portion 3, a sheet delivery portion 4, and a data processing portion 5 in an apparatus housing 1.

The sheet feeding portion 2 includes a plurality of cassette mechanisms 2*a*, 2*b*, and 2*c* configured to store sheets for image formation having different sizes, respectively, and is configured to send out a sheet having a size designated by a main body controller (not shown) to a sheet feeding path 6. Each of the cassette mechanisms 2*a*, 2*b*, and 2*c* is removably placed in the sheet feeding portion 2. Each of the cassette mechanisms 2*a*, 2*b*, and 2*c* includes a separating mechanism configured to separate sheets stored therein into individual sheets, and a sheet feeding mechanism configured to send out the sheets. On the sheet feeding path 6, there are arranged conveyance rollers configured to feed sheets, which are fed from the cassette mechanisms 2*a*, 2*b*, and 2*c*, to downstream. At an end portion of the path, there is arranged a registration roller pair configured to align leading edges of sheets.

A large capacity cassette 2*d* and a manual feed tray 2*e* are connected to the sheet feeding path 6. The large capacity cassette 2*d* is an optional unit configured to store certain size sheets which are consumed in large amounts. The manual feed tray 2*e* is configured to enable feeding of special sheets, such as thick sheets, coated sheets, or film sheets, which are difficult to be separated and fed.

The image printing portion 3 is, for example, an electrostatic printing mechanism, and includes a photosensitive drum 9 to be rotated. In the periphery of the photosensitive drum 9, the image printing portion 3 includes a light emitting device 10 configured to emit an optical beam, a developing device 11, and a cleaner (not shown). The image printing portion 3 illustrated in FIG. 1 is a monochromatic printing mechanism, which is configured to optically form a latent image on the photosensitive drum 9 with the light emitting device 10 and allow toner to adhere to the latent image with the developing device 11.

A sheet is fed from the sheet feeding path 6 to the image printing portion 3 at a timing of forming an image on this photosensitive drum 9. The image is transferred onto the sheet by a transfer charger 12 and fixed by a fixing roller 13 arranged on a sheet delivery path 14. On the sheet delivery path 14, there are arranged a sheet delivery roller 15 and a sheet delivery port 16 to convey the sheet having the image formed thereon to the sheet processing apparatus B.

The scanner unit A2 includes a platen 17 for placing an image original, a carriage 18 configured to reciprocate along the platen 17, a photoelectric conversion unit 19, and a reduction optical system 20 configured to guide light, which is emitted from the carriage 18 and reflected from the original placed on the platen 17, to the photoelectric conversion unit 19. The photoelectric conversion unit 19 is configured to convert optical output from the reduction optical system 20 into image data through photoelectric conversion and output the image data as an electric signal to the image printing portion 3.

Further, the scanner unit A2 includes a running platen 21 to read a sheet fed from the feeder unit A3. The feeder unit A3 includes a sheet feeding tray 22, a sheet feeding path 23 configured to guide the sheet fed from the sheet feeding tray 22 to the running platen 21, and a sheet delivery tray 24 configured to receive the original having passed above the running platen 21. The original fed from the sheet feeding tray 22 is read through use of the carriage 18 and the reduction optical system 20 when the original passes above the running platen 21.

Figure 2:
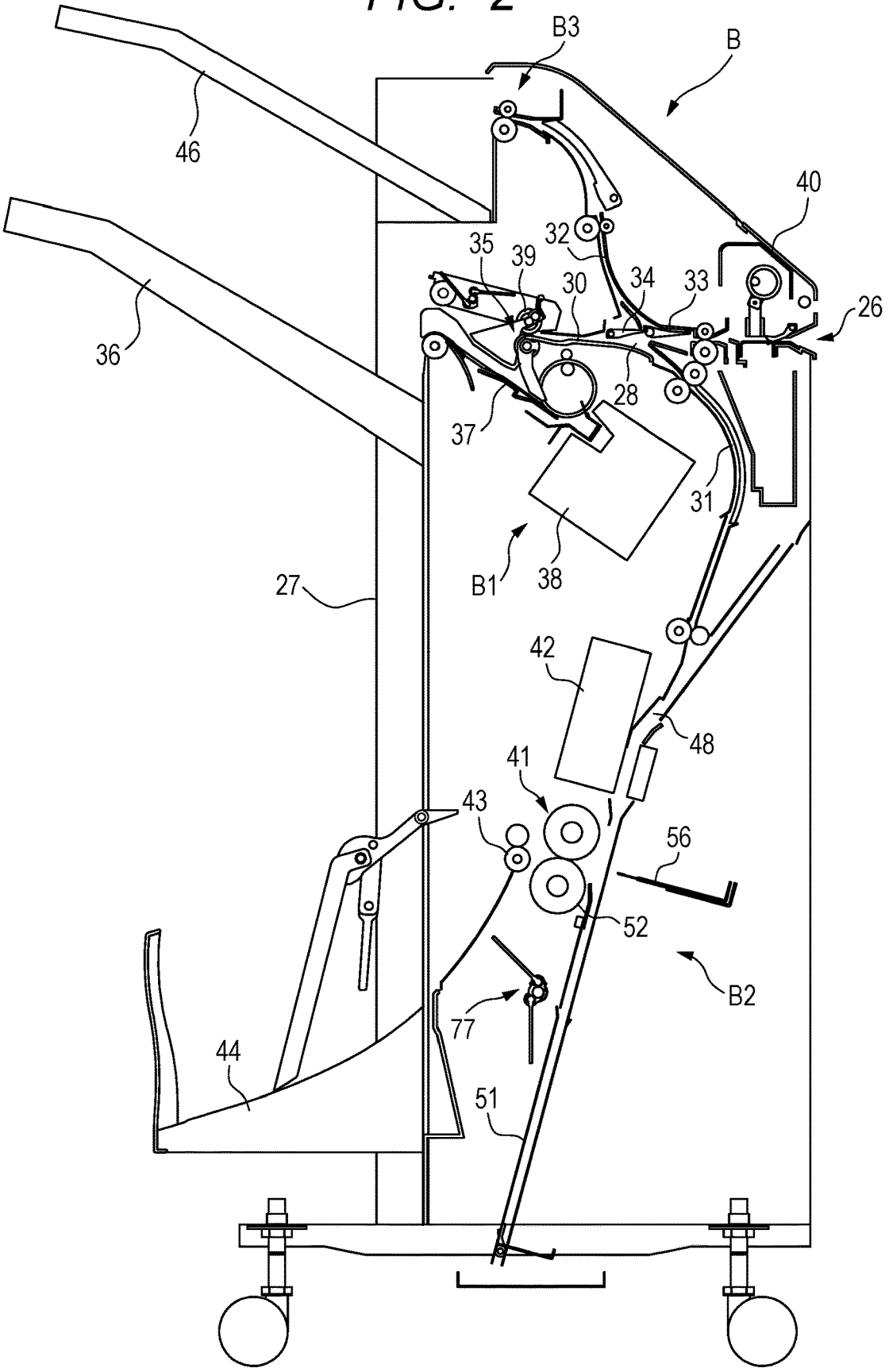
FIG. 2 is an explanatory view for illustrating an overall configuration of a sheet processing apparatus in the image forming system of FIG. 1.

FIG. 2 is a view for illustrating a configuration of the sheet processing apparatus B configured to perform post-processing on a sheet, which is conveyed from the image forming apparatus A and has an image formed thereon. The sheet processing apparatus B includes an apparatus housing 27 having a carry-in port 26 configured to introduce a sheet from the image forming apparatus A. The apparatus housing 27 is arranged to be aligned with the housing 1 of the image forming apparatus A so as to allow the carry-in port 26 to communicate with the sheet delivery port 16 of the image forming apparatus A.

The sheet processing apparatus B includes a sheet carry-in path 28 through which a sheet introduced through the carry-in port 26 is conveyed, a first sheet delivery path 30, a second sheet delivery path 31, and a third sheet delivery path 32, which are formed to branch out from the sheet carry-in path 28, a first path-switching unit 33, and a second path-switching unit 34. The first path-switching unit 33 and the second path-switching unit 34 are flapper guides configured to switch conveyance directions of a sheet conveyed on the sheet carry-in path 28.

The first path-switching unit 33 is configured to be switched by a drive unit (not shown) between a mode of guiding a sheet from the carry-in port 26 to the directions of the first sheet delivery path 30 and the second sheet delivery path 31, and a mode of guiding the sheet to the third sheet delivery path 32. The first sheet delivery path 30 and the second sheet delivery path 31 communicate with each other so as to enable switch-back conveyance of reversing the conveyance direction of a sheet which has once been introduced to the first sheet delivery path 30 and introducing the sheet to the second sheet delivery path 31.

The second path-switching unit 34 is arranged on downstream of the first path-switching unit 33 in the conveyance direction of a sheet conveyed on the sheet carry-in path 28. The second path-switching unit 34 is similarly configured to be switched by a drive unit (not shown) between a mode of introducing a sheet having passed through the first path-switching unit 33 to the first sheet delivery path 30, and a mode of performing the switch-back conveyance of introducing a sheet which has once been introduced to the first sheet delivery path 30 to the second sheet delivery path 31.

The sheet processing apparatus B includes a first processing portion B1, a second processing portion B2, and a third processing portion B3 which are configured to perform different types of post-processing, respectively. Further, on the sheet carry-in path 28, there is arranged a punching unit 40 configured to form a punch hole in the conveyed sheet.

The first processing portion B1 is a binding processing portion configured to collect a plurality of sheets conveyed from a sheet delivery port 35 formed at a downstream end of the first sheet delivery path 30 in the conveyance direction of sheets conveyed on the sheet carry-in path 28, align the sheets, and perform binding processing on the sheets. The first processing portion B1 delivers the sheets to a stacking tray 36 arranged on an outer side of the apparatus housing 27. The first processing portion B1 includes a sheet conveying device 37 configured to convey a sheet or a bundle of sheets, and a binding processing unit 38 configured to perform binding processing on a bundle of sheets. At the downstream end of the first sheet delivery path 30, there is arranged a delivery roller pair 39 configured to deliver a sheet from the sheet delivery port 35 and to perform the switch-back conveyance from the first sheet delivery path 30 to the second sheet delivery path 31.

The second processing portion B2 is configured to form a plurality of sheets conveyed through the switch-back conveyance from the second sheet delivery path 31 into a bundle of sheets, perform binding processing on the bundle of sheets, and perform folding processing. The second processing portion B2 includes a folding processing device 41 configured to perform folding processing on a sheet or a bundle of sheets having been conveyed, and a binding processing unit 42 which is arranged on immediate upstream of the folding processing device 41 along the sheet conveyance direction of the sheet conveyed to the second sheet delivery path 31 and is configured to perform binding processing on a bundle of sheets. The bundle of sheets subjected to folding processing is delivered by a delivery roller 43 to a stacking tray 44 arranged on the outer side of the apparatus housing 27.

The third processing portion B3 is configured to perform jog-sorting on sheets conveyed from the third sheet delivery path 32 to group the sheets into a group of sheets to be collected while being offset by a predetermined amount in a direction orthogonal to the conveyance direction and a group of sheets to be collected without being offset. The sheets having been subjected to the jog-sorting are delivered to a stacking tray 46 arranged on the outer side of the apparatus housing 27. Thus, a bundle of sheets being offset and a bundle of sheets not being offset are stacked.

Figure 3:
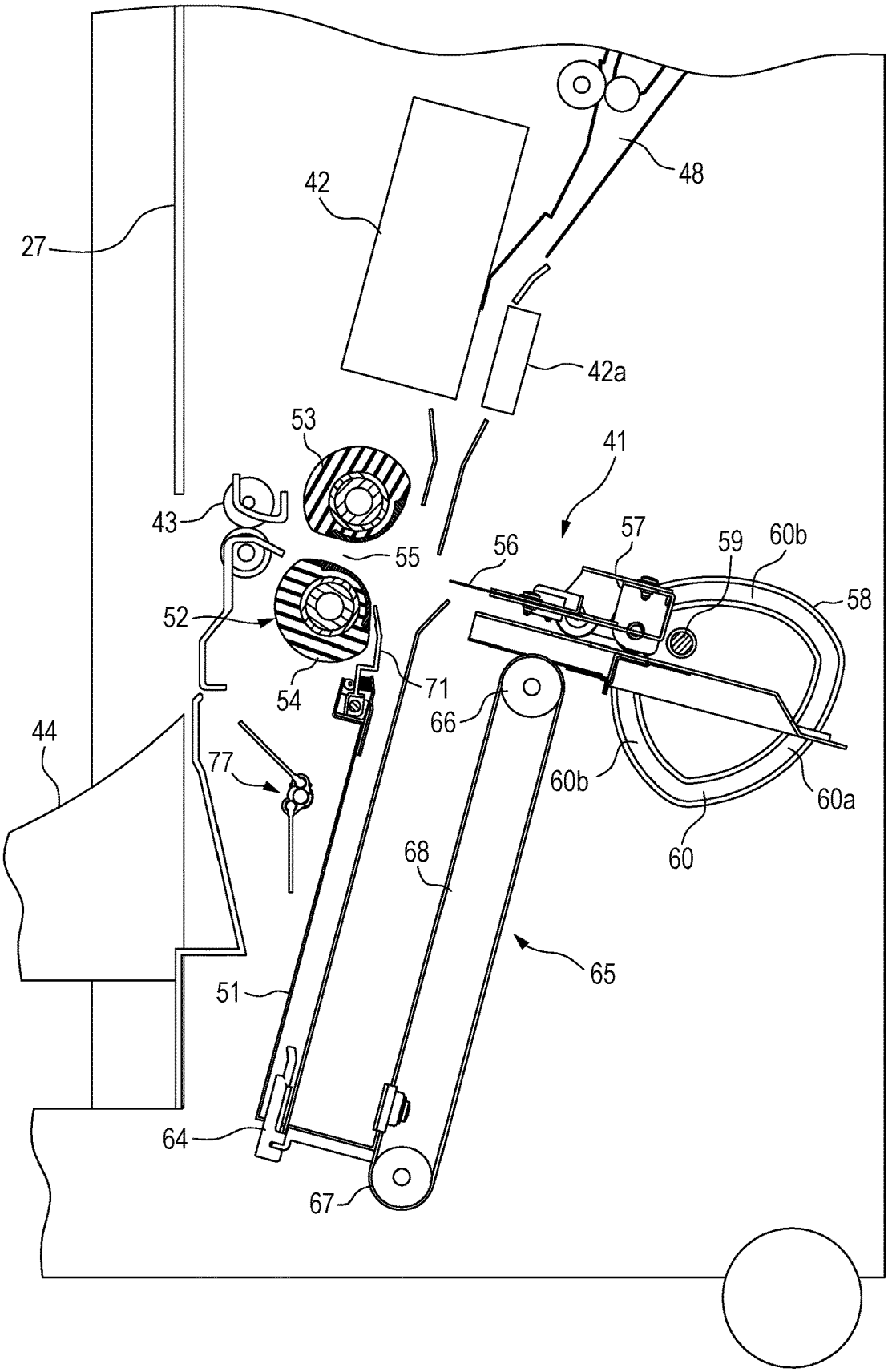
FIG. 3 is a sectional view for illustrating a folding processing device of the sheet processing apparatus of FIG. 2.

FIG. 3 is a view for schematically illustrating an overall configuration of the second processing portion B2. The second processing portion B2 includes the folding processing device 41 configured to perform folding processing of folding a bundle of sheets, which is conveyed from the second sheet delivery path 31, collected, and aligned, and the binding processing unit 42 configured to perform binding processing on the bundle of sheets before being subjected to folding processing. The binding processing unit 42 illustrated in FIG. 3 is a stapler device configured to bind a bundle of sheets by driving a staple. A stapleless binding device configured to perform binding processing on a bundle of sheets without use of staples may be used for the binding processing unit 42.

In order to convey sheets to the folding processing device 41, a sheet conveyance path 48 is connected to the second sheet delivery path 31. On downstream of the sheet conveyance path 48 in the conveyance direction of the sheets to be conveyed from the second sheet delivery path 31 to a sheet stacking tray 51, the sheet stacking tray 51 is arranged. The sheet stacking tray 51 constructing a part of the sheet conveyance path 48 is configured to position and stack the sheets to be subjected to the folding processing. The stacking tray 51 is an inclined placement portion for placing the sheets having been conveyed from a conveyance unit by rollers arranged on the second sheet delivery path 31. On immediate upstream of the sheet stacking tray 51, there are arranged the binding processing unit 42 and a staple receiving portion 42*a* thereof at opposed positions over the sheet conveyance path 48.

On one side of the sheet stacking tray 51, a folding roller pair 52 is arranged so as to be opposed to one surface of a sheet or a bundle of sheets to be stacked on the sheet stacking tray 51. The folding roller pair 52 includes folding rollers 53 and 54 having roller surfaces held in press contact with each other, and is arranged so that a press-contact portion 55 of the folding roller pair is oriented toward the sheet stacking tray 51. The folding rollers 53 and 54 are arranged next to each other on upstream and downstream along the carry-in direction of a sheet conveyed to the sheet stacking tray 51 so as to be substantially equidistant from the sheet stacking tray 51. The folding rollers 53 and 54 are configured to nip the folded sheet to form a crease extending in a direction intersecting the conveyance direction of the sheet conveyed from the second sheet delivery path 31 to the sheet stacking tray 51. A folding unit is not limited to rollers, and may be constructed by a rotatory belt. The folding roller pair 52 may be constructed so that a plurality of folding rollers (rotary members) arranged serially along an axial direction of each of the folding rollers 53 and 54.

On a side opposite to the folding roller pair 52 over the sheet stacking tray 51, there is arranged a folding blade 56 serving as a pressing member. The folding blade 56 has a leading edge oriented toward the press-contact portion 55 of the folding roller pair 52 and is carried by a blade carrier 57. The blade carrier 57 is arranged so as to be runnable in a direction substantially perpendicularly transverse to the sheet stacking tray 51, that is, in a direction intersecting the conveyance direction of a sheet conveyed from the second sheet delivery path 31 to the sheet stacking tray 51.

On both sides of the blade carrier 57 in the forward and backward directions in FIG. 3, that is, in the axial direction of the folding rollers, there are arranged cam members 58 (only one cam member on the back side is illustrated in FIG. 3), which are constructed by a pair of eccentric cams mirror symmetrical to each other, at opposed positions. The cam members 58 are rotated by a drive unit, e.g., a drive motor (not shown) about a rotary shaft 59 arranged at an eccentric position of the cam members 58. Each cam member 58 has a cam groove 60 along an outer peripheral edge thereof.

The cam groove 60 has a cam profile including a first cam surface 60*a* having a maximum radius from the rotary shaft 59, and second cam surfaces 60*b* being arranged on both sides in a circumferential direction of the first cam surface 60*a* and each having a radius smaller than that of the first cam surface 60*a*. The blade carrier 57 includes a cam pin (not shown) serving as a cam follower to be freely slidably fitted to the cam groove 60.

Figure 4:
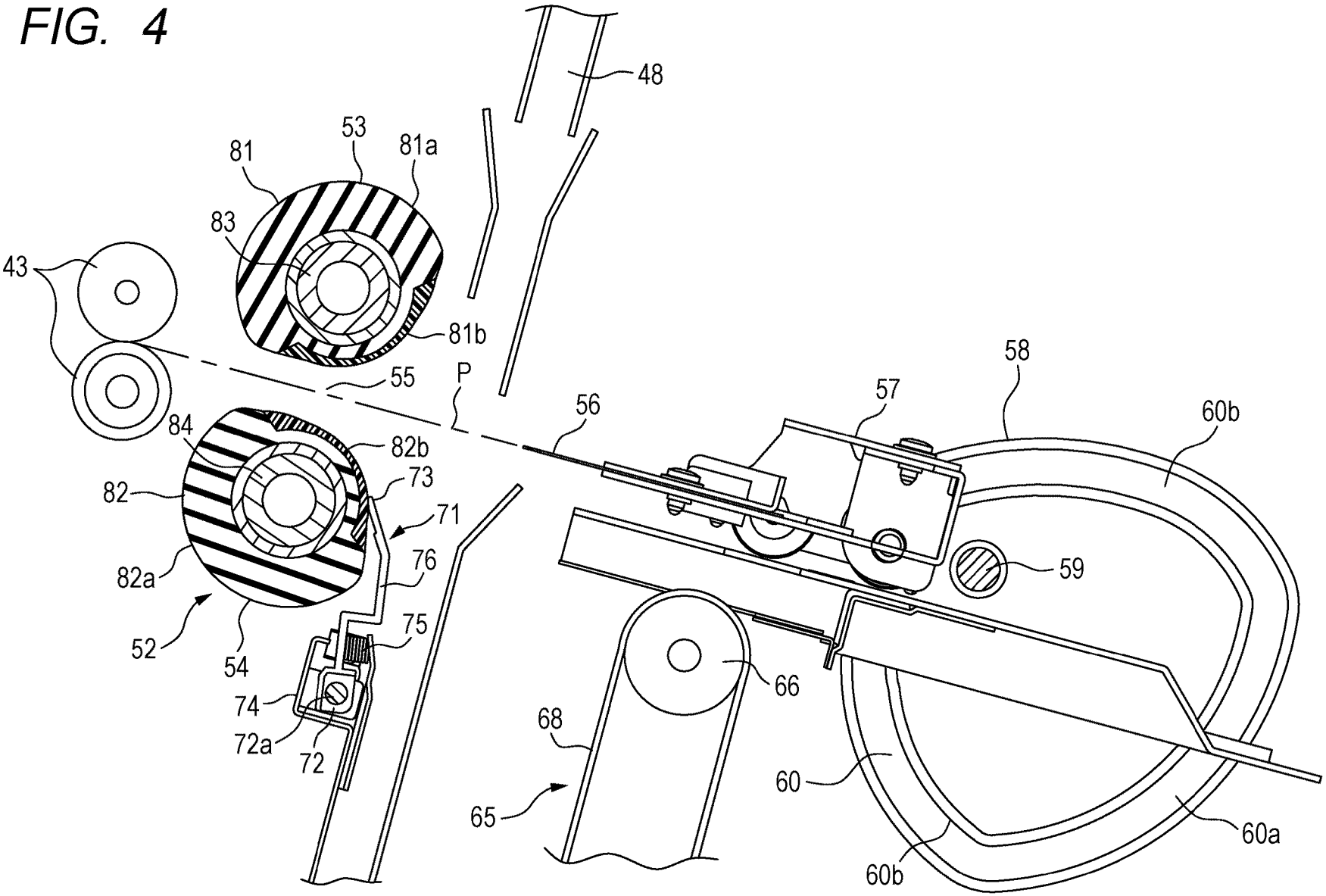
FIG. 4 is an enlarged sectional view for illustrating relevant parts of the folding processing device according to the first embodiment.

When the cam members 58 are rotated by the drive motor, the blade carrier 57 runs in directions of approaching to or separating from the sheet stacking tray 51 by following the cam profile. With this, as illustrated in FIG. 4, the folding blade 56 can be linearly moved in a freely advanceable and retreatable manner between an initial position and a maximum pressing position along a pressing path P connecting the initial position and the maximum pressing position. At the initial position, the leading edge of the folding blade 56 does not enter the sheet conveyance path 48. At the maximum pressing position, the leading edge of the folding blade 56 is sandwiched at the press-contact portion 55 of the folding roller pair 52. The folding blade 56 presses the sheet into the press-contact portion 55 so that the sheet is folded. The folding roller pair 52 and the folding blade 56 construct the folding unit.

At a lower end of the sheet stacking tray 51, there are arranged regulating stoppers 64 configured to allow a leading edge of a conveyed sheet to come into contact therewith to regulate the leading edge of the sheet. The regulating stoppers 64 serve as a regulation unit configured to regulate and hold a sheet, which is to be placed on the sheet stacking tray 51 being the placement portion, at a placement position through contact with an end edge of the sheet in the conveyance direction. The regulating stoppers 64 can be raised and lowered along the sheet stacking tray 51 by a sheet raising and lowering mechanism 65.

The sheet raising and lowering mechanism 65 is a conveyor belt mechanism including a pair of pulleys 66 and 67 arranged on a back side of the sheet stacking tray 51 and in the vicinity of an upper end and a lower end of the sheet stacking tray 51 along the sheet stacking tray 51, and a transmission belt 68 wound around both pulleys 66 and 67. The regulating stoppers 64 are fixed on the transmission belt 68. The pulley 66 or the pulley 67 on the drive side is rotated by a drive unit, e.g., a drive motor, to thereby cause the regulating stoppers 64 to be raised and lowered between a lower end position illustrated in FIG. 3 and a desired height position. With this, a sheet or a bundle of sheets can be moved along the sheet stacking tray 51.

The sheet raising and lowering mechanism 65 is configured to transfer a sheet or a bundle of sheets from a placement position, at which the sheet or the bundle of sheets is supported by the regulating stoppers 64, to the folding processing position. When a length dimension of a sheet in the conveyance direction exceeds a predetermined value, the sheet raising and lowering mechanism 65 raises the regulating stoppers 64 to transfer the sheet to the folding processing position. When the length dimension is equal to or less than the predetermined value, the sheet raising and lowering mechanism 65 lowers the regulating stoppers 64 to transfer the sheet to the folding processing position. The sheet raising and lowering mechanism 65 is a moving unit configured to move a sheet or a bundle of sheets supported by the regulating stoppers 64 to the folding processing position.

Figure 9A:
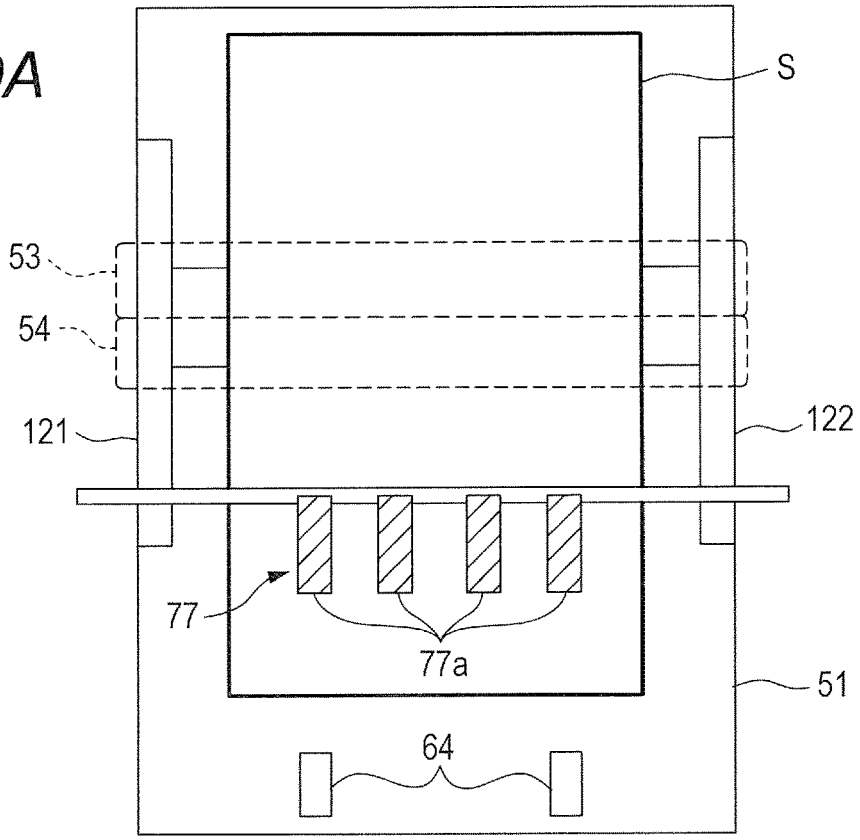
FIG. 9A is a view for schematically illustrating an operation to be performed when sheets less than a predetermined number are delivered to the sheet processing apparatus.

The folding processing device 41 includes a paddle wheel 77. As illustrated in FIG. 9A, the paddle wheel 77 has a configuration in which columns of paddles 77*a*, which include four paddles 77*a*, aligned along the width direction of the sheet stacking tray 51 are arranged to be symmetrical over a rotary shaft. Through rotation of the paddle wheel 77, the paddles 77*a* in the two pairs of columns sequentially appear in the sheet stacking tray 51. The paddle wheel 77 is configured to convey a sheet introduced into the sheet stacking tray 51 to the regulating stoppers 64. With this, the paddle wheel 77 serves as a support and regulation position adjustment unit configured to perform position adjustment in the conveyance direction with respect to the sheet, and is driven by a drive unit, e.g., a motor (not shown).

The folding processing device 41 further includes a sheet guide member 71 being a guide portion arranged between the sheet stacking tray 51 and the folding roller pair 52. In the folding processing device 41 illustrated in FIG. 4, the sheet guide member 71 is arranged on the folding roller 54 side on downstream. The sheet guide member 71 may be constructed by a plate-like member extending along the axial direction of the folding roller 54. The sheet guide member 71 includes a base end portion and a leading edge portion 73 serving as a contact portion. The base end portion 72 is arranged on downstream of the folding roller 54 in the conveyance direction of a sheet conveyed from the second sheet delivery path 31 to the sheet stacking tray 51. The leading edge portion 73 is located on upstream of the base end portion 72 and brought into contact with the roller surface of the folding roller 54. The contact portion which causes the sheet guide member 71 to be brought into contact with the roller 54 is integrally formed with the sheet guide member 71.

The base end portion 72 of the sheet guide member 71 is accommodated in a bracket 74 fixed on an outer side of the sheet stacking tray 51. The leading edge portion 73 is axially supported so as to be swingable about a rotary shaft 72*a* of the base end portion 72 in directions of approaching to and separating from a rotary shaft center of the folding roller 54. The sheet guide member 71 is always urged against the folding roller 54 side by a compression coil spring 75 interposed between the sheet guide member 71 and the bracket 74. With this, when the folding roller 54 is rotated, the leading edge portion 73 of the sheet guide member 71 is always held in slide contact with the roller surface of the folding roller 54. The base end portion 72 of the sheet guide member 71 may be swung in accordance with the rotation position of the roller surface of the folding roller 54.

The leading edge portion 73 of the sheet guide member 71 is arranged so as to come into contact with the roller surface of the folding roller 54 at a position substantially corresponding to the rotary shaft center of the folding roller 54 or a position beyond that position as viewed from downstream to upstream along the sheet conveyance direction. With this, on downstream from the leading edge portion 73, that is, the side opposite to the press-contact portion 55, the sheet guide member 71 covers a part of the roller surface of the folding roller 54 on the sheet stacking tray 51 side. In other words, the sheet guide member 71 covers the roller surface of the folding roller 54 at a part excluding the press-contact portion 55 and the vicinity thereof in the folding roller pair 52.

Between the leading edge portion 73 and the base end portion 72 of the sheet guide member 71, there is formed a gently inclined surface 76 serving as a guide surface gradually reduced in gap with the sheet stacking tray 51 toward the downstream. This inclined surface 76 is swung about the rotary shaft 72*a* integrally with the contact portion held in contact with the roller 54. For example, the sheet guide member 71 is formed of a plate member made of metal or rigid plastic. Thus, a friction coefficient of the inclined surface 76 is significantly smaller than that of at least folding rollers made of a material having a large friction coefficient, e.g., a rubber material.

Figure 5:
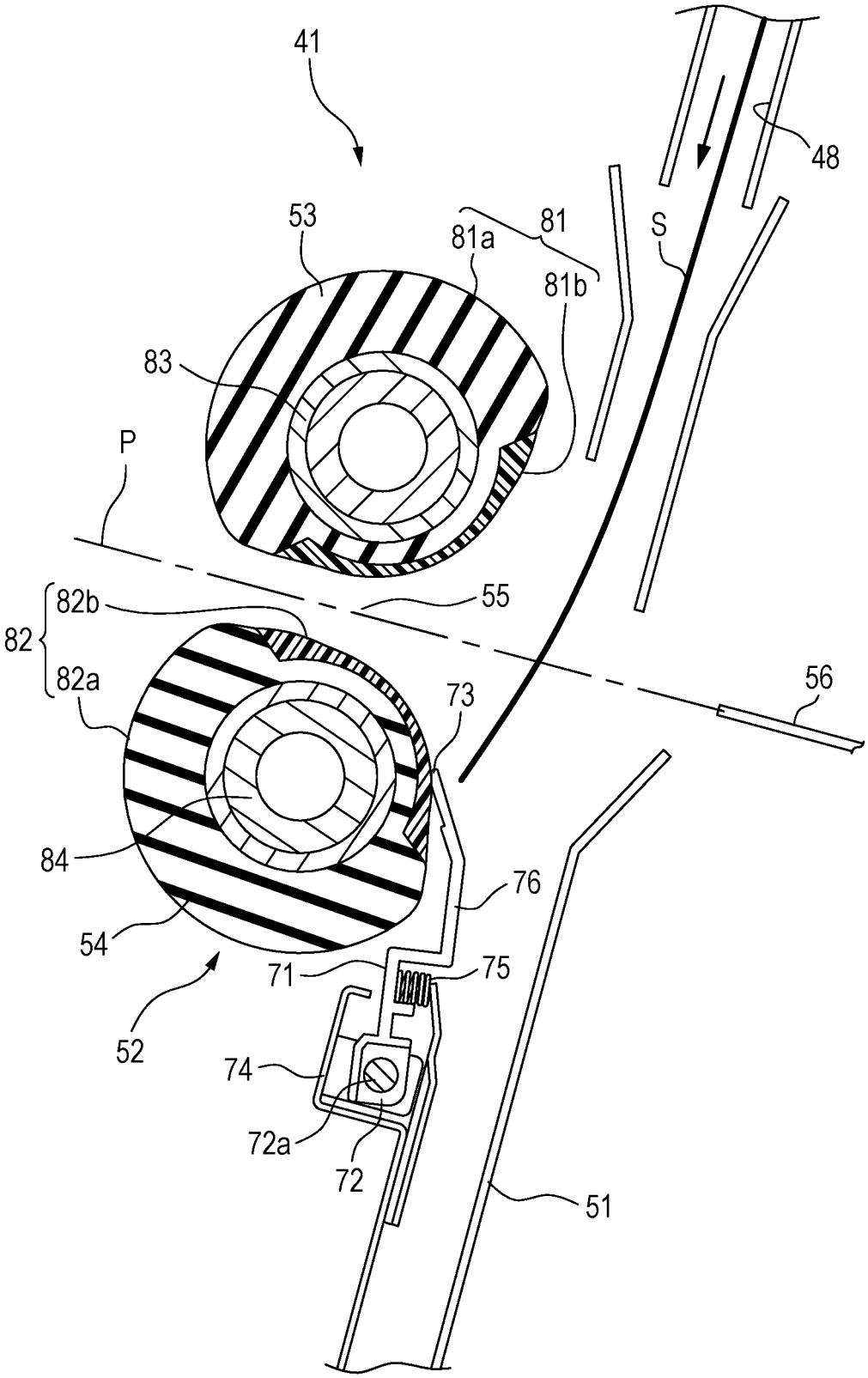
FIG. 5 is an explanatory view for illustrating a positional relationship between a folding roller pair and a sheet guide member during carry-in a sheet.

With the inclined surface 76 and the leading edge portion 73 held in contact with the roller surface of the folding roller 54, as illustrated in FIG. 5, a sheet S is more reliably returned to the sheet stacking tray 51. Even when the leading edge of the sheet S conveyed to the sheet stacking tray 51 is curled, the sheet S is prevented from deviating from the sheet stacking tray 51 toward the folding roller pair 52 side on the course and being caught by the circumferential surfaces of the folding roller pair 52, or is prevented from being sandwiched in a gap formed with the leading edge portion 73 of the sheet guide member 71. Thus, jamming of the sheet conveyed to the folding processing device 41 can be effectively prevented.

When a bundle of sheets is conveyed on the sheet conveyance path 48 from the sheet stacking tray 51 toward the upstream for binding processing, and when the bundle of sheets is conveyed toward the downstream for folding processing after the binding processing, a sheet on the side closest to the folding roller pair 52 is brought into contact with a surface of the folding roller 54. With this, a fear in that a sheet on the closest side and an inner sheet cause deviation is eliminated. With this, formation of a crease on a sheet surface due to the deviation between sheets of the bundle of sheets, and removal of some sheets from the bound portion can be prevented.

Figure 6:
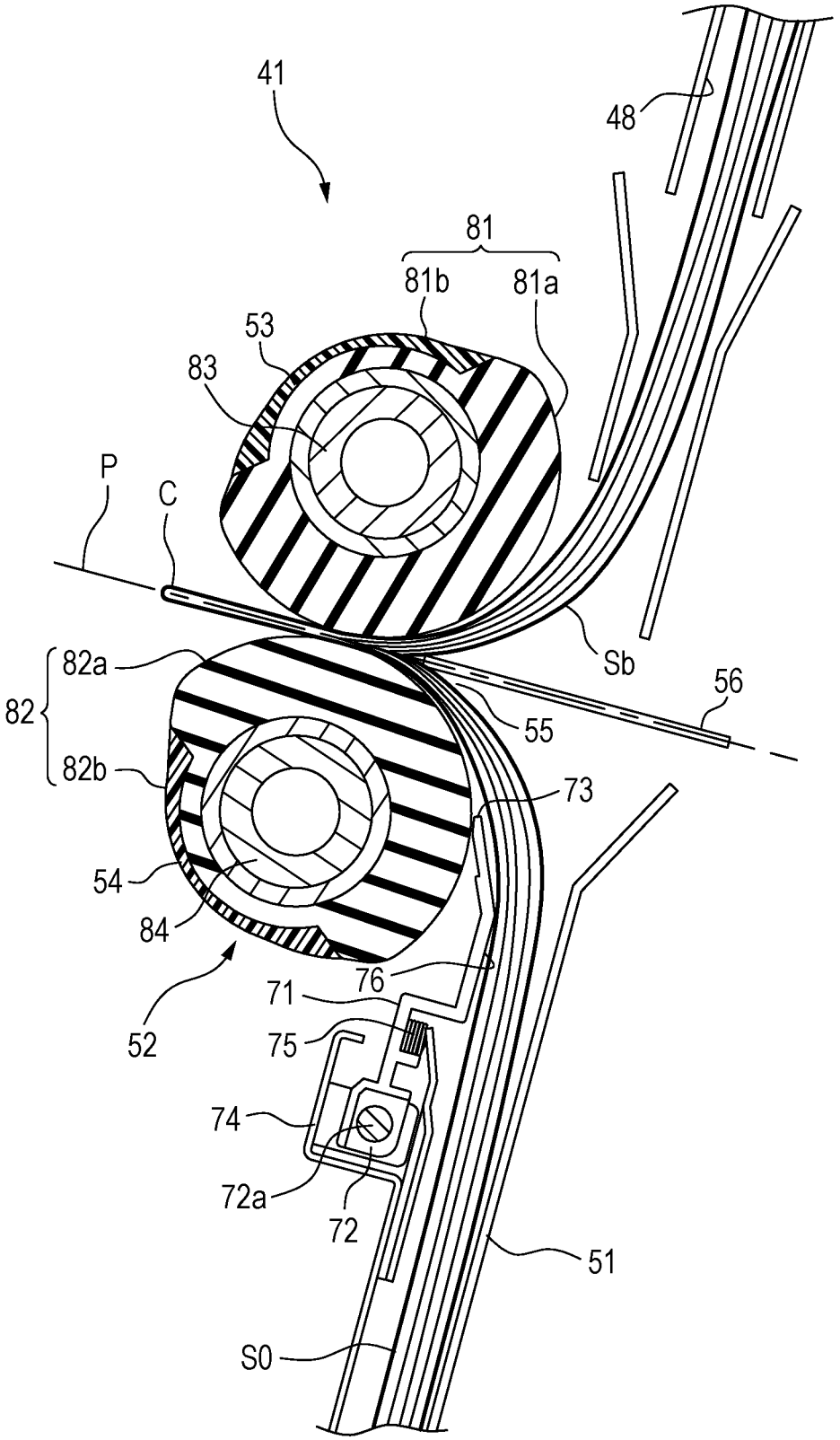
FIG. 6 is an explanatory view for illustrating a positional relationship between the folding roller pair and the sheet guide member during folding processing.

FIG. 6 is a view for illustrating a state in which a bundle of sheets Sb in the sheet stacking tray 51 is folded in half by the folding blade 56 and pushed into the press-contact portion 55 of the folding roller pair 52. At this time, a sheet S0 on the outermost side of the bundle of sheets Sb, that is, on the folding roller pair 52 side is guided by the inclined surface 76 of the sheet guide member 71 and delivered into the press-contact portion 55. The inclined surface 76 has a small friction coefficient, and hence the sheet S0 moves smoothly while being held in slide contact with the inclined surface 76. Thus, fears in deviation between the sheet S0 and an inner sheet, and folding processing with deviated sheets are eliminated.

As illustrated in FIG. 4, the folding rollers 53 and 54 of the folding roller pair 52 have roller surfaces 81 and 82, respectively. First roller surfaces 81*a* and 82*a* have a constant radius R1 about rotary shaft centers of the rotary shafts 83 and 84. A distance from the rotary shaft centers of the rotary shafts 83 and 84 to second roller surfaces 81*b* and 82*b* is smaller than the radius R1 of the first roller surfaces 81*a* and 82*a*. The first roller surfaces 81*a* and 82*a* are made of a rubber material having a relatively high friction coefficient as in a typical roller surface. In contrast, the second roller surfaces 81*b* and 82*b* are made of a plastic resin material having a friction coefficient smaller than that of the first roller surfaces 81*a* and 82*a*.

The rotary shafts 83 and 84 of the folding rollers 53 and 54 are driven to rotate by a common drive unit, e.g., a drive motor. With this, rotation positions of the first roller surfaces 81*a* and 82*a* and the second roller surfaces 81*b* and 82*b* can always be synchronized. The rotary shafts 83 and 84 can be driven by a drive motor in common with the cam members 58.

At an initial position before starting the folding processing, as illustrated in FIG. 4, the second roller surfaces 81*b* and 82*b* are arranged so as to be oriented toward the sheet conveyance path 48 side at positions symmetrical with respect to the pressing path P of the folding blade 56. The leading edge portion 73 of the sheet guide member 71 is urged with the compression coil spring 75. Thus, the leading edge portion 73 is similarly brought into slide contact with both the first roller surface 82*a* and the second roller surface 82*b* irrespective of the rotation position of the folding roller 54. Specifically, the sheet guide member 71 serving as a guide portion for a sheet is configured to move in conformity with the rotation position of the folding roller serving as the rotary portion while being held in contact with one of the first roller surface 82*a* and the second roller surface 82*b* which are circumferential surfaces of the folding roller 54.

Figure 7:
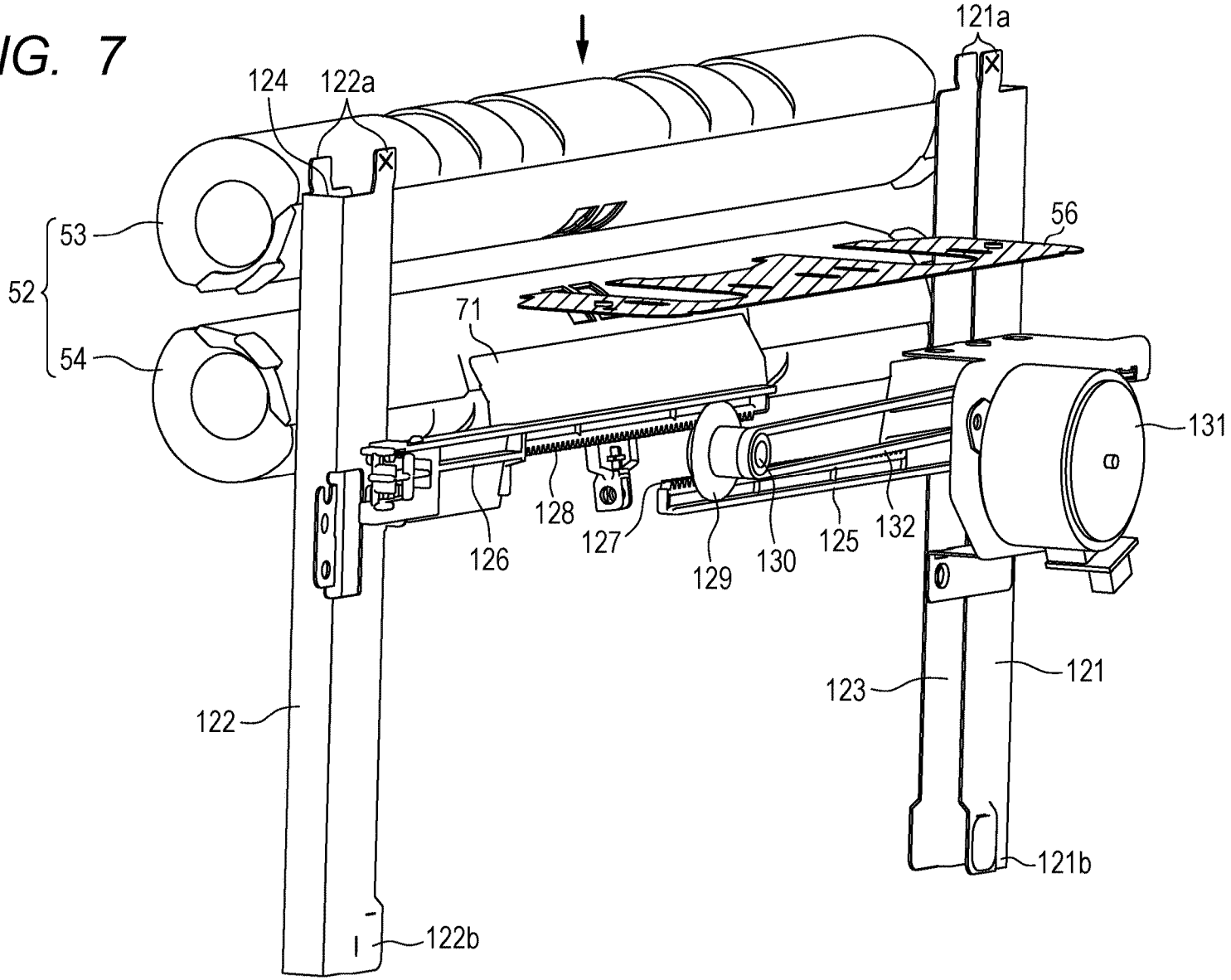
FIG. 7 is a perspective view for illustrating relevant parts of the sheet processing apparatus as viewed from a folding blade side.

The sheet stacking tray 51 further includes position adjusting units configured to perform position adjustment in a direction along an end edge of a sheet placed on the stacking tray 51, that is, in a direction intersecting the conveyance direction of a sheet. As illustrated in FIG. 7, the position adjusting units include sheet side edge adjustment members 121 and 122 which are a pair of position adjustment members spaced apart and arranged symmetrically in a direction orthogonal to a sheet carry-in direction indicated by the arrow in FIG. 7. The sheet side edge adjustment members 121 and 122 may approach to and separate from each other in the direction orthogonal to the sheet carry-in direction. Upper ends 121*a* and 122*a* and lower ends 121*b* and 122*b* of the sheet side edge adjustment members 121 and 122 are held so as to be movable by a guide portion (not shown) fixed on the apparatus housing 27 side.

The sheet side edge adjustment members 121 and 122 are each formed of a frame member having a substantially U-shaped cross section extending along the sheet carry-in direction, and are arranged parallel to each other with opening portions of the substantially U-shapes opposed to each other. Inner surfaces of the substantially U-shape of the sheet side edge adjustment members 121 and 122 define sheet side edge regulating surfaces 123 and 124 configured to adjust positions of side edges of the sheets in the sheet stacking tray 51 in a direction orthogonal to the sheet carry-in direction, that is, a width direction of the sheets. In particular, the sheet side edge regulating surfaces 123 and 124 each having the substantially U-shaped cross section can regulate the side edges of the sheets in the sheet stacking tray 51 not only in the sheet width direction but also in a thickness direction of the sheets, that is, a thickness direction of the sheet stacking tray (sheet conveyance path 48). In this example, both the sheet side edge adjustment members 121 and 122 are movable. However, even when only one of the sheet side edge adjustment members 121 and 122 is movable, the position adjustment along the end edge direction of the sheets can be performed.

At respective outer surfaces of the sheet side edge adjustment members 121 and 122 on the folding blade 56 side near a center in the longitudinal direction, there are integrally fixed guide rail members 125 and 126 linearly extending toward other sheet side edge adjustment member. The guide rail members 125 and 126 are arranged parallel in the vertical direction of FIG. 7 with a predetermined gap in the sheet carry-in direction so that at least respective leading edge sides partially overlap with each other.

On the lateral sides of the guide rail members 125 and 126 opposed to each other in the vertical direction, there are arranged racks 127 and 128, respectively. When the sheet side edge adjustment members 121 and 122 approach to and separate from each other, a predetermined gap is held by the racks 127 and 128 in the sheet carry-in direction. A common pinion 129 axially supported on the apparatus housing 27 side in a freely rotatable manner is concurrently meshed with both the racks 127 and 128.

On the pinion 129, there is mounted a driven pulley 130 coaxially with the pinion 129 and on the folding blade 56 side so as to be integrally rotatable. On the pulley 130, there is wound a transmission belt 132 so that power can be transmitted between the pulley 130 and a pulley on a driving side (not shown) connected to an output shaft of a sheet side edge adjusting motor 131 fixed on the apparatus housing 27 side.

The sheet side edge adjustment members 121 and 122 are moved by equal distance in synchronization so as to approach to or separate from each other in the width direction of the sheets through rotation of the pinion 129 by driving the motor 131. With this, when a position of a sheet in the sheet stacking tray 51 is deviated in the sheet width direction, the sheet side edge regulating surface 123 or 124 can be brought into contact with the lateral side of the sheet to move the sheet to a desired adjustment position.

Figure 18:
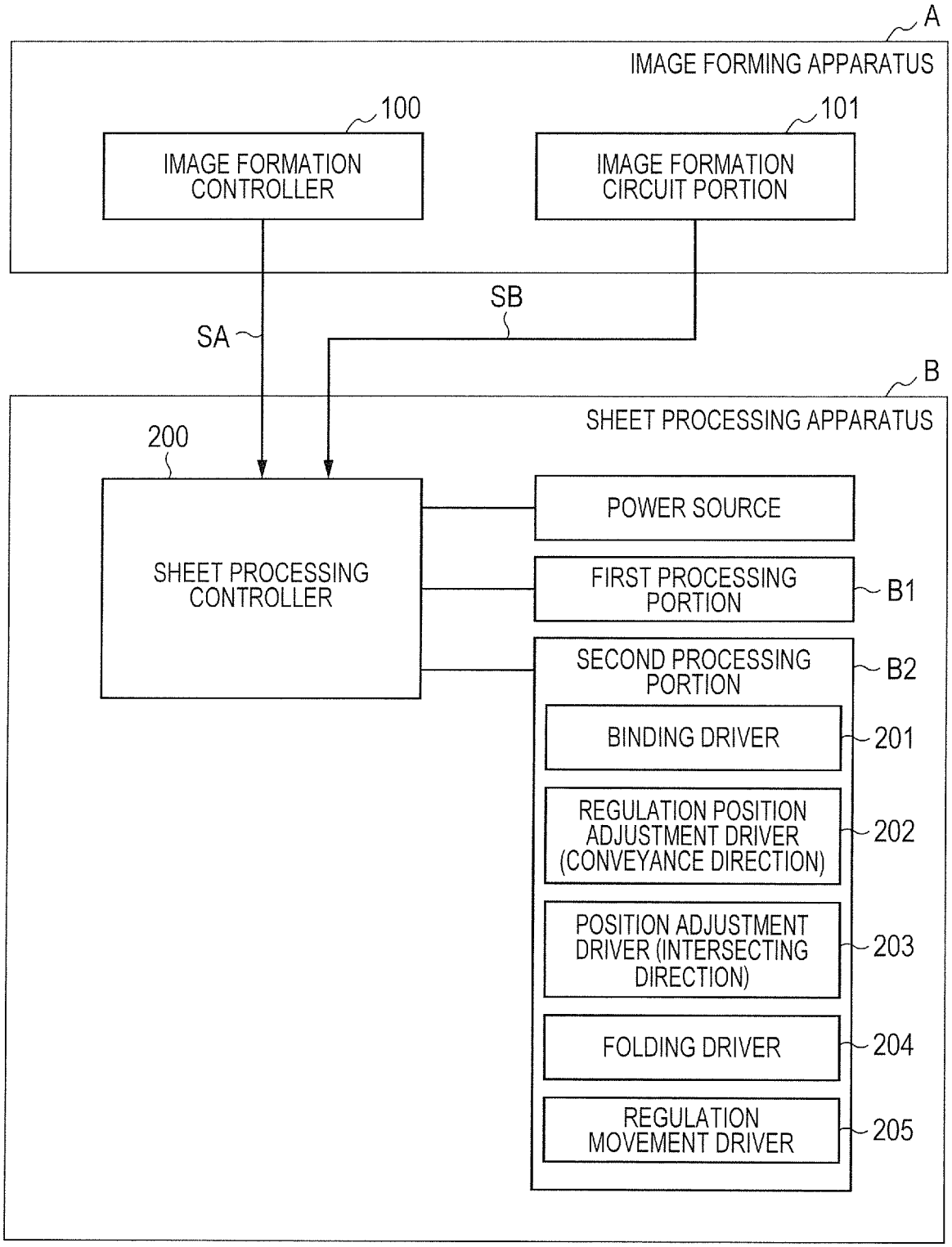
FIG. 18 is a block diagram for illustrating an electric circuit portion of the image forming system according to the first embodiment.

An overall configuration of an electric circuit of the image forming system 1000 is described with reference to the block diagram illustrated in FIG. 18. The image forming apparatus A includes an image formation circuit portion 101 and an image formation controller 100. The image formation circuit portion 101 is an electric circuit for the image forming unit A1, the scanner unit A2, and the feeder unit A3. The image formation controller 100 is configured to integrally control operations of the image formation circuit portion 101. The sheet processing apparatus B includes a sheet processing controller 200 serving as a control unit configured to integrally control operations of sheet processing. The sheet processing controller 200 is configured to control driving of devices included in the first processing portion B1 and the second processing portion B2. For example, in a case of the second processing portion B2, the sheet processing controller 200 controls operations of a binding driver 201 for binding processing units 38 and 42, a regulation position adjustment driver 202 configured to drive the paddle wheel 77, a position adjustment driver 203 configured to drive the sheet side edge adjustment members 121 and 122, a folding driver 204 configured to drive the folding roller pair 52 and the folding blade 56, and a regulation movement driver 205 configured to drive the regulating stoppers 64.

From the image formation controller 100 to the sheet processing controller 200, an instruction signal indicating which of the folding processing and the binding processing is to be performed, an instruction signal indicating whether or not to perform sheet folding with high accuracy, and a signal SA indicating the size and number of sheets to be delivered from the image forming apparatus A to the sheet processing apparatus B are transmitted. From the image formation circuit portion 101 to the sheet processing controller 200, a signal SB indicating a timing of delivering a sheet having an image formed thereon to the sheet processing apparatus B. The sheet processing controller 200 starts receiving a sheet in accordance with input of the signal SB.

Figure 8A:
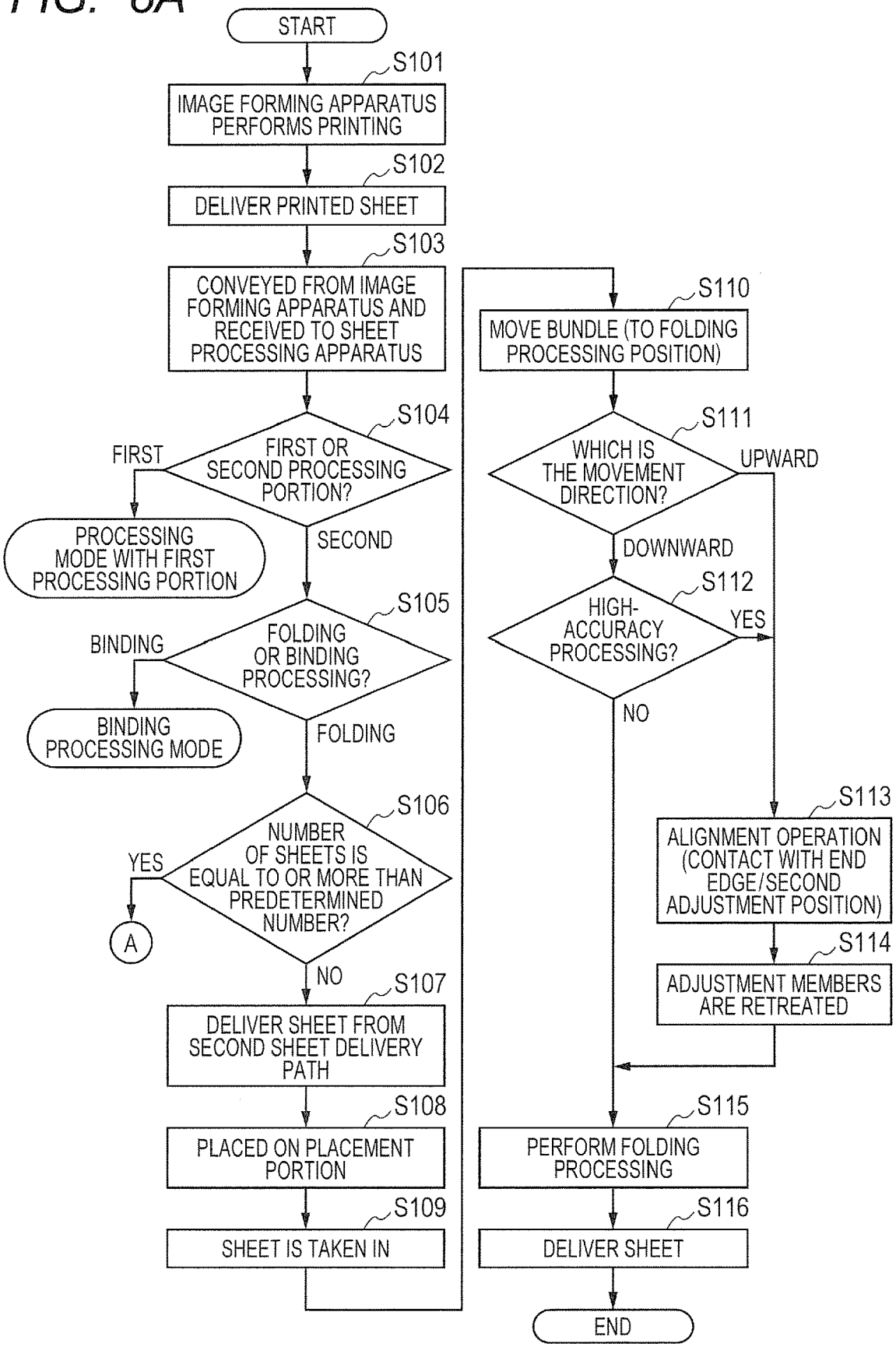
FIG. 8A is a flowchart for illustrating operations of the sheet processing apparatus.

Operations of the image forming system 1000 are described with reference to flowcharts illustrated in FIG. 8A and FIG. 8B.

The image forming system 1000 performs printing in the image forming apparatus A in accordance with a control by the image formation controller 100 (Step S101), and thereafter delivers a printed sheet to the sheet processing apparatus B (Step S102). Next, after the sheet is delivered from the image forming apparatus A to the sheet processing apparatus B (Step S103), the sheet processing controller 200 determines which of the first processing portion B1 and the second processing portion B2 is to be used to process the delivered sheet. At this time, the sheet processing controller 200 determines in accordance with the signal SA transmitted from the image formation controller 100 (Step S104).

In a case of processing with the first processing portion B1, the sheet processing controller 200 executes a control in a mode of processing a sheet with the first processing portion B1. Processing operations with the first processing portion B1 are not directly related to the present invention, and hence description thereof is omitted.

In a case of processing with the second processing portion B2, the sheet processing apparatus B performs operations from next Step S105 in accordance with a control by the sheet processing controller 200.

First, in accordance with the signal SA transmitted from the image formation controller 100, the sheet processing controller 200 determines which of the folding processing and the binding processing for a sheet is instructed (Step S105). In this case, when the binding processing is instructed, the step proceeds to a control in a binding processing mode.

When the folding processing is instructed by the image formation controller 100, the sheet processing controller 200, similarly in accordance with the signal SA, determines whether or not the number of sheets to be subjected to the folding processing indicated by the image formation controller 100 is less than a predetermined number (Step S106).

Figure 9B:
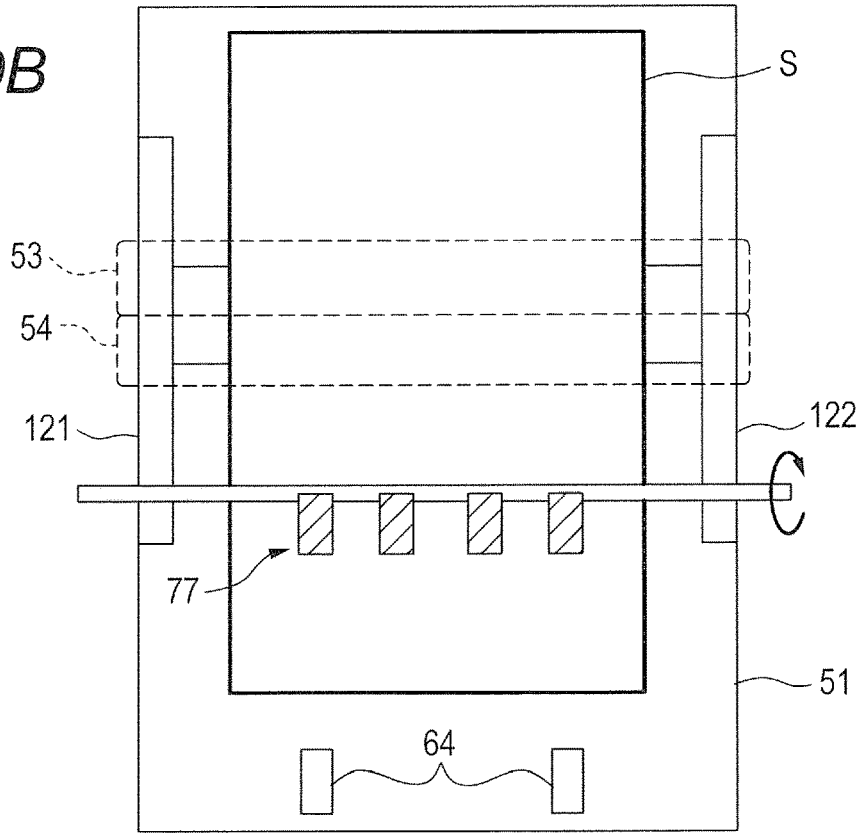
FIG. 9B is a view for schematically illustrating the operation to be performed when the sheets less than the predetermined number are delivered to the sheet processing apparatus.
Figure 10:
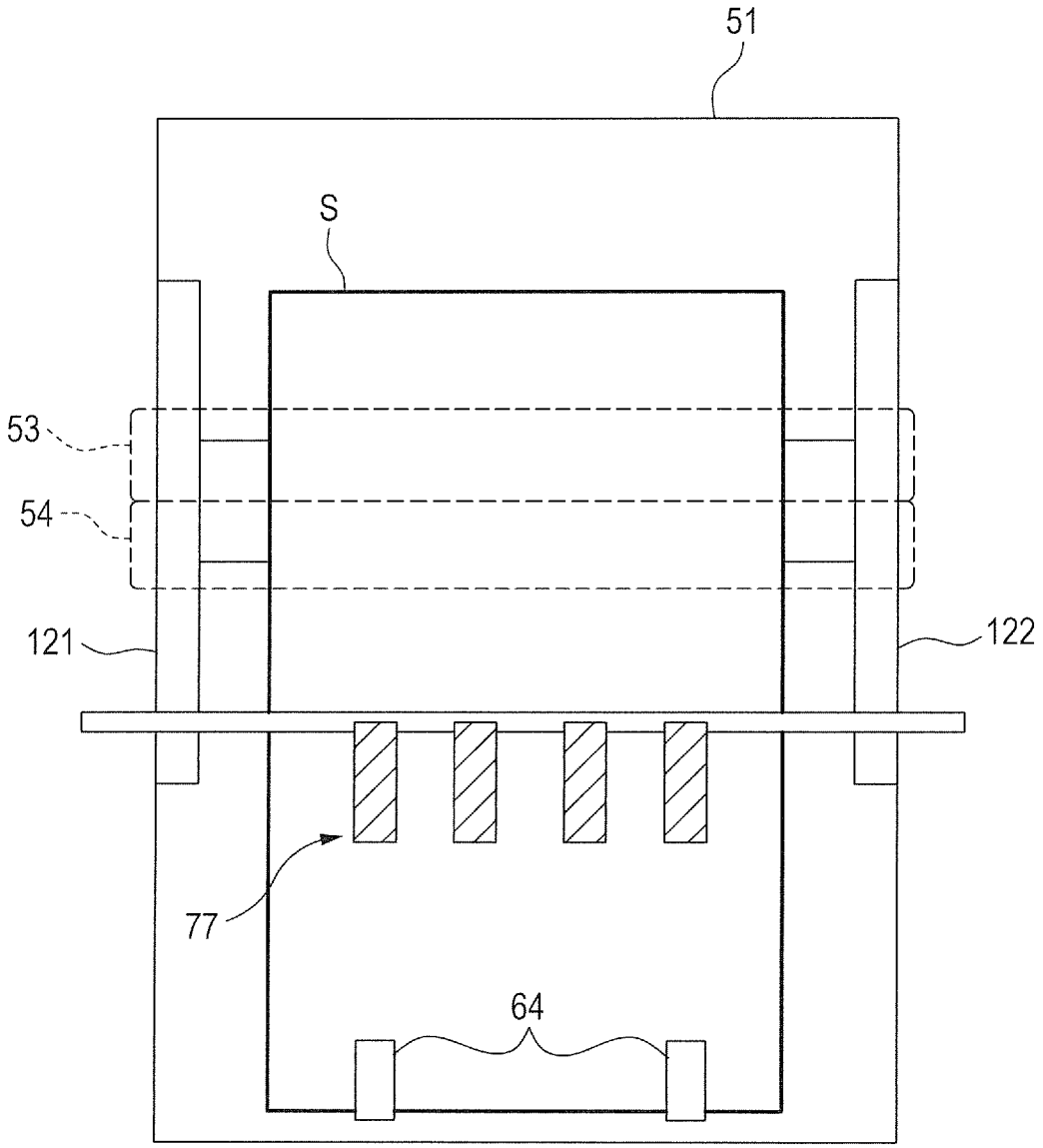
FIG. 10 is a view for schematically illustrating a state in which the delivered sheets in FIG. 9A and FIG. 9B are held by regulating stoppers.

When the number of sheets sequentially delivered from the image forming apparatus A to the carry-in port 26 is less than a predetermined number, the sheet processing controller 200 proceeds to processing in Step S107. Through the control by the sheet processing controller 200 in Step S107, in the folding processing device 41, a sheet S passes through the second sheet delivery path 31 to be delivered to the stacking tray 51. As illustrated in FIG. 9A, the sheet S is placed on the placement portion (Step S108). Herein, through rotation of the paddles 77*a* of the paddle wheel 77 in the direction of the arrow (illustrated in FIG. 9B), the sheet S is taken in (Step S109). With this, as illustrated in FIG. 10, the sheet S is transferred to a placement position reaching the regulating stoppers 64. A position of the sheet S in the conveyance direction is adjusted in the course of the transfer. Further, a sheet to be subsequently delivered is also similarly taken in by the paddle wheel 77 and transferred to the placement position.

Figure 11:
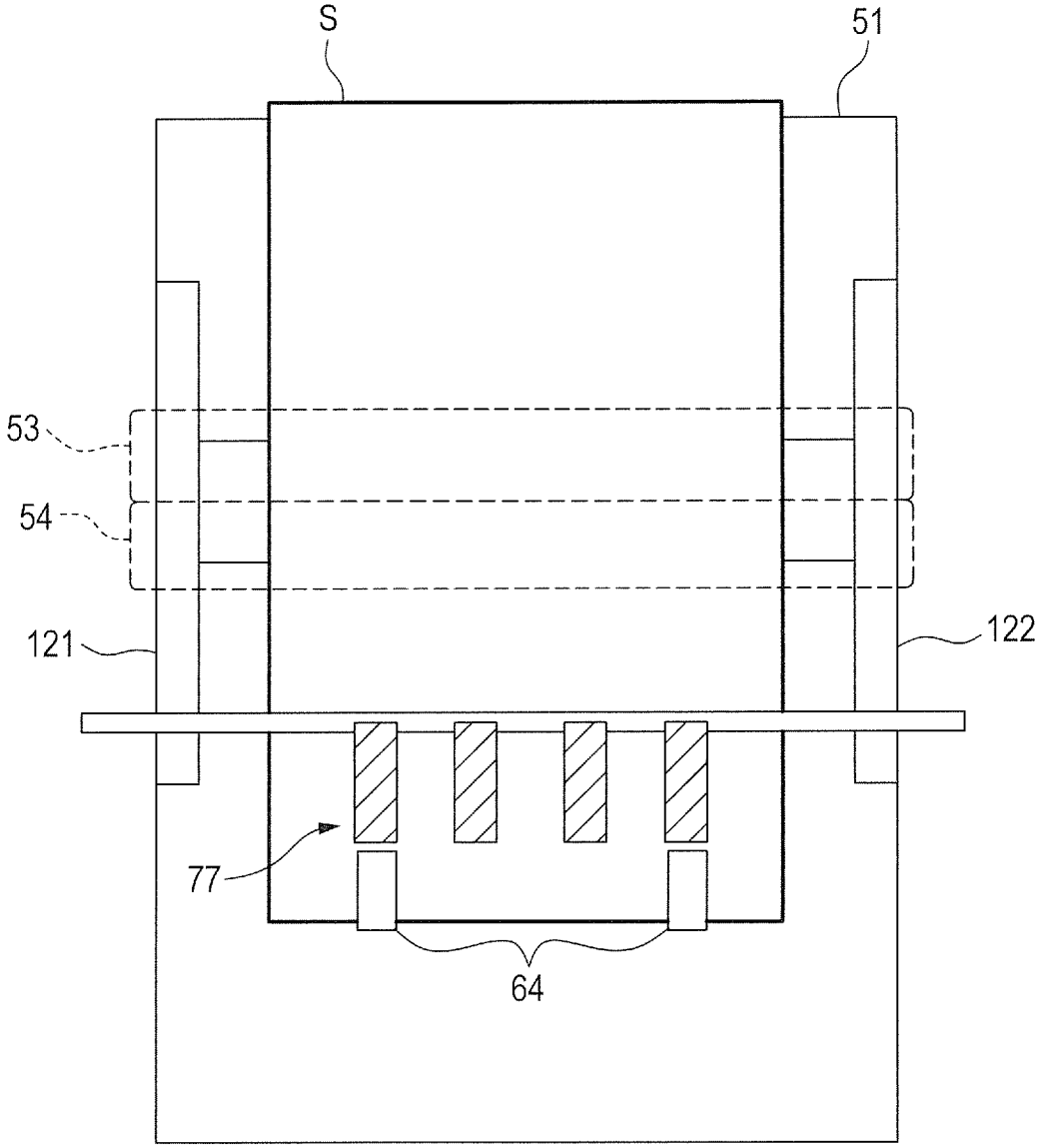
FIG. 11 is a view for schematically illustrating an operation of the regulating stoppers to transfer sheets to a folding processing position.

After all of sheets S less than a predetermined number reach the regulating stoppers 64, as illustrated in FIG. 11, the regulating stoppers 64 next move upward or downward in accordance with a length dimension of the sheets S in the conveyance direction. Then, the regulating stoppers 64 cause a center portion of the sheets S to move to a predetermined folding processing position opposed to the folding blade 56 of the folding processing device 41 (Step S110).

Figure 12A:
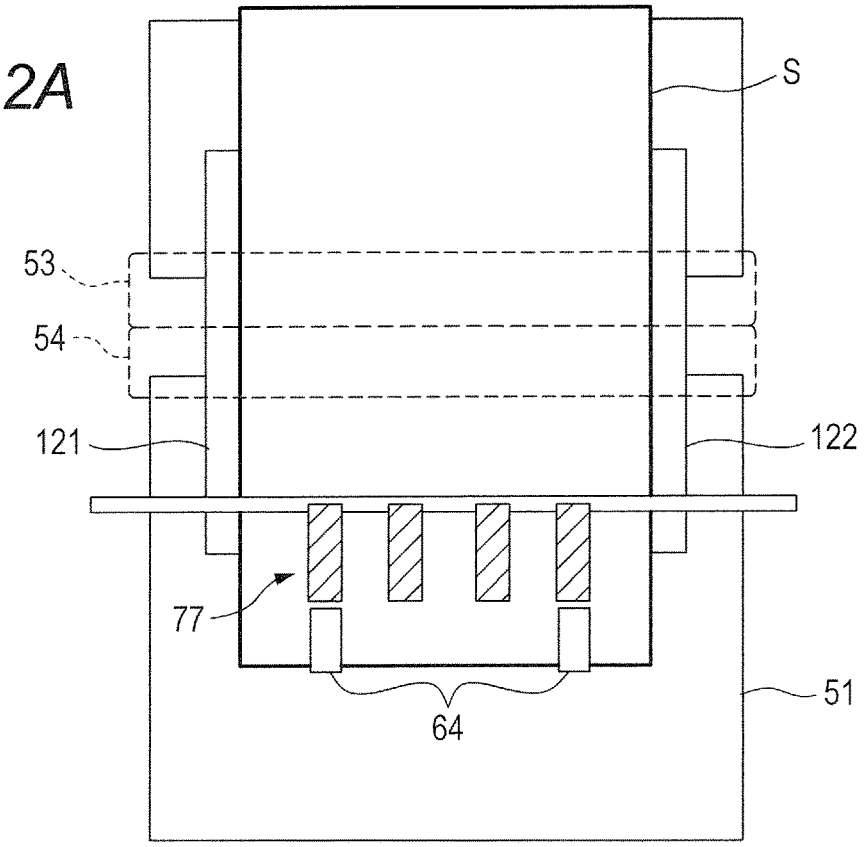
FIG. 12A is a view for schematically illustrating an operation of performing alignment of sheets transferred to the folding processing position.

In this case, when the sheet processing controller 200 determines in Step S111 that the sheets are to be moved upward, an alignment operation is performed after the sheets S are moved from the placement position to the folding processing position (Step S113). In the alignment operation, as illustrated in FIG. 12A, rotation of the motor 131 causes the sheet side edge adjustment members 121 and 122 to move from initial positions by a predetermined equal distance in accordance with the width dimension of the sheets in the sheet stacking tray 51. Then, a position of the sheets S is adjusted so that a center position of the sheets S in the width direction matches with a center line of the sheets in the sheet stacking tray 51 along the conveyance direction of the sheets. Thus, the sheets S are aligned and adjusted in position by the sheet side edge adjustment members 121 and 122 at the folding processing position being a second adjustment position.

Figure 12B:
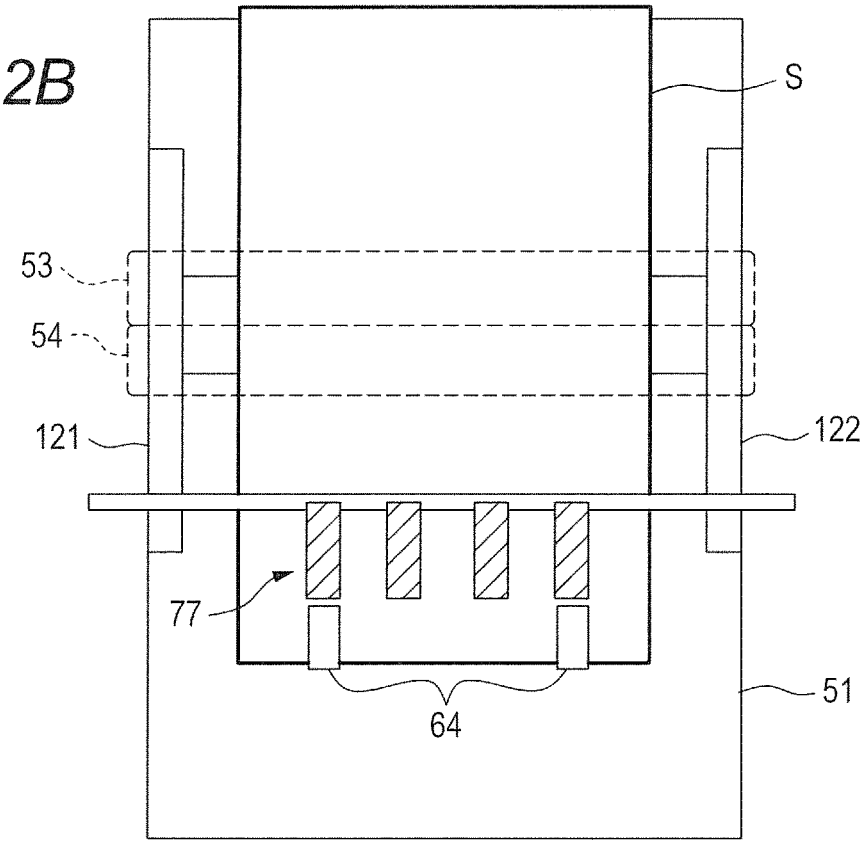
FIG. 12B is a view for schematically illustrating the operation of performing alignment of the sheets transferred to the folding processing position.

Next, as illustrated in FIG. 12B, the sheet side edge adjustment members 121 and 122 are retreated to release the alignment (Step S114). Then, the folding blade pushes the center portion of the sheet to the nip position of the folding rollers 53 and 54 to perform the folding processing (Step S115).

In Step S110, when the sheet S is a sheet having a small size, and the regulating stoppers 64 are moved downward, the sheet processing controller 200 determines in Step S112 whether or not folding processing with high accuracy is instructed by the image formation controller 100. Then, in a case of high-accuracy processing (first mode) ("YES" in Step S112), the step proceeds to processing in Step S113. After the alignment operation is performed, the sheet side edge adjustment members 121 and 122 are retreated, and the folding processing is performed. In contrast, in a case of not performing the high-accuracy processing (second mode) ("NO" in Step S112), the alignment operation is not performed. After the sheet S is moved, the folding processing is performed in Step S115. After the folding processing is performed, the sheet is delivered to the stacking tray 44 (Step S116). Thus, all of the operations of the image forming system 1000 are completed.

When the number of sheets S to be subjected to the folding processing is less than a predetermined number, and the sheets S are sheets having a small size, and the high-accuracy folding processing is not to be performed, the position adjustment through the alignment operation of the sheet side edge adjustment members 121 and 122 is not to be performed. When the paddle wheel 77 performs rotation of taking in the sheets S, the position adjustment for the sheets in the conveyance direction is performed. Thus, the position adjustment by the sheet side edge adjustment members 121 and 122 is omitted. In this case, time required for the alignment operation can be omitted, and hence productivity can be improved.

In a case where there is one sheet S, or there are a small number of sheets S less than a predetermined number, when the sheet S is to be moved to the folding processing position, the stiffness of the sheet S is small, which may result in flexure caused by buckling due to delayed conveyance. Even when the flexure occurs, the flexure of the sheet S may be corrected to an upright posture by performing the alignment operation with the sheet side edge adjustment members 121 and 122 before the sheet S is pushed to the nip position of the folding rollers 53 and 54 by the folding blade 56. Thus, high-accuracy folding processing of accurately forming a crease at a center portion of the sheet S is performed.

Figure 8B:
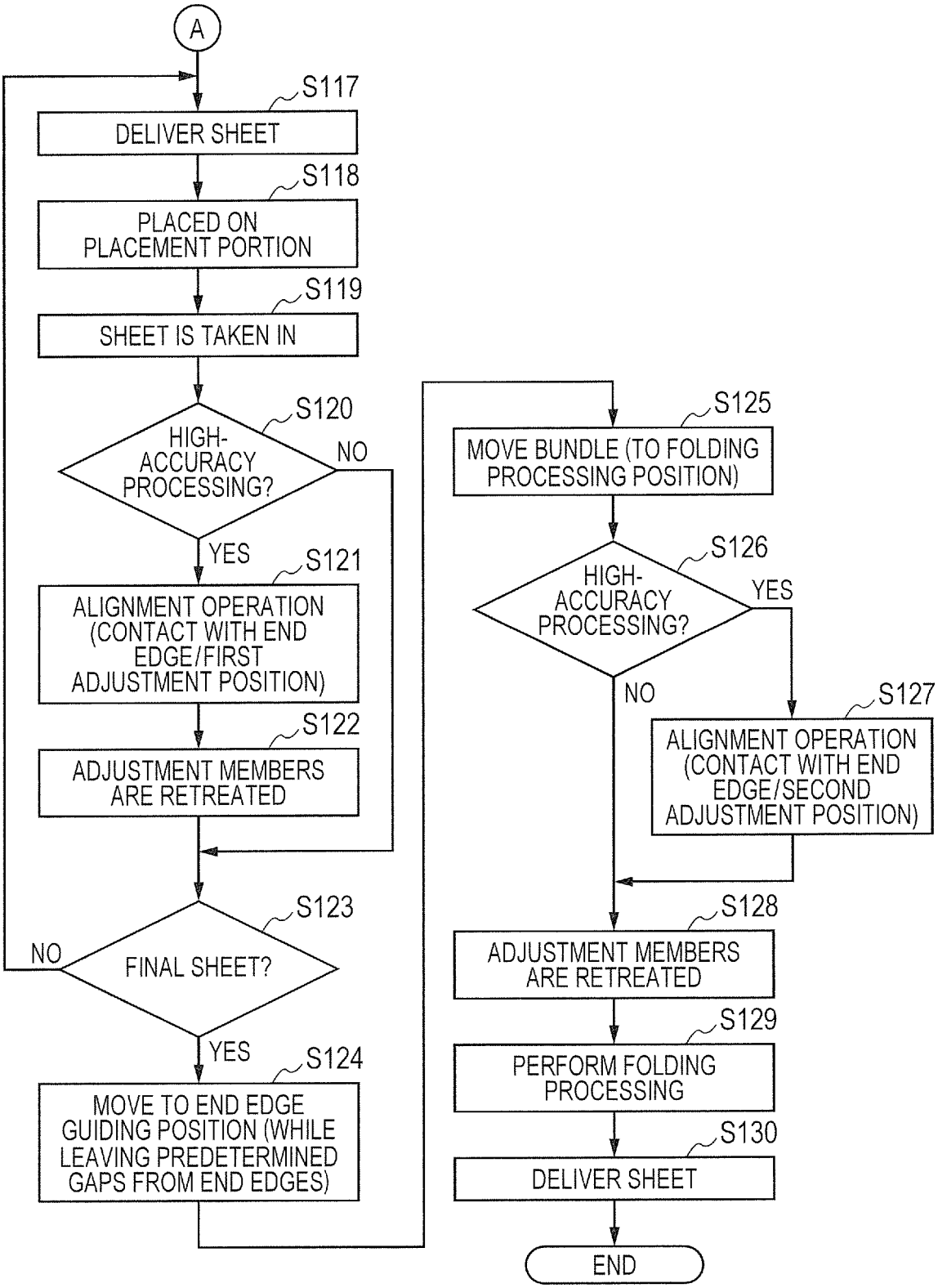
FIG. 8B is a flowchart for illustrating operations of the sheet processing apparatus, which are subsequent to FIG. 8A.

Next, with reference to the flowchart of FIG. 8B, description is made of operations to be performed when, in processing of Step S106, the sheet processing controller 200 determines that the number of sheets to be subjected to the folding processing is equal to or larger than a predetermined number ("YES" in Step S106).

The sheet S is delivered through the second sheet delivery path 31 to the stacking tray 51 (Step S117), and the sheet S is placed on the placement portion (Step S118). After that, through rotation of the paddles 77*a* of the paddle wheel 77, the sheet S is taken in (Step S119). Then, the sheet S is transferred to the placement position of reaching the regulating stoppers 64. The operations described above are the same as those described with reference to FIG. 9A, FIG. 9B, and FIG. 10. At this time, until the sheet S reaches the regulating stoppers 64, the position adjustment in the conveyance direction is performed on the sheet S.

After the sheet S is transferred to the placement position, the sheet processing controller 200 determines whether or not the high-accuracy folding processing is instructed by the image formation controller 100 (Step S120). When the high-accuracy processing is instructed, the alignment operation is performed in Step S121. That is, the sheet side edge adjustment members 121 and 122 are moved by a predetermined equal distance from the initial positions in accordance with the width dimension of the sheet in the sheet stacking tray 51. Then, the sheet is adjusted in position so that the center position of the sheet in the width direction matches with a center line of the sheet in the sheet stacking tray 51 along the conveyance direction. In this case, the sheet S is adjusted in position at the first adjustment position being the placement position through alignment by the sheet side edge adjustment members 121 and 122.

Next, the sheet side edge adjustment members 121 and 122 are retreated to release the alignment (Step S122). After that, the sheet processing controller 200 determines whether or not the sheet adjusted in position is the final sheet to be subjected to the folding processing (Step S123). When the sheet is not the final sheet, the step returns to the processing in Step S117, and the second and subsequent sheets S to be delivered from the second sheet delivery path 31 are processed. In a case where the number of sheets S to be subjected to the folding processing is equal to or larger than a predetermined number, and the high-accuracy processing is to be performed, the alignment operation for the sheets S in the width direction is repeated each time a sheet is delivered from the second sheet delivery path 31. With this, a plurality of sheets can be aligned and collected at a predetermined position in the width direction in the sheet stacking tray 51.

Figure 13A:
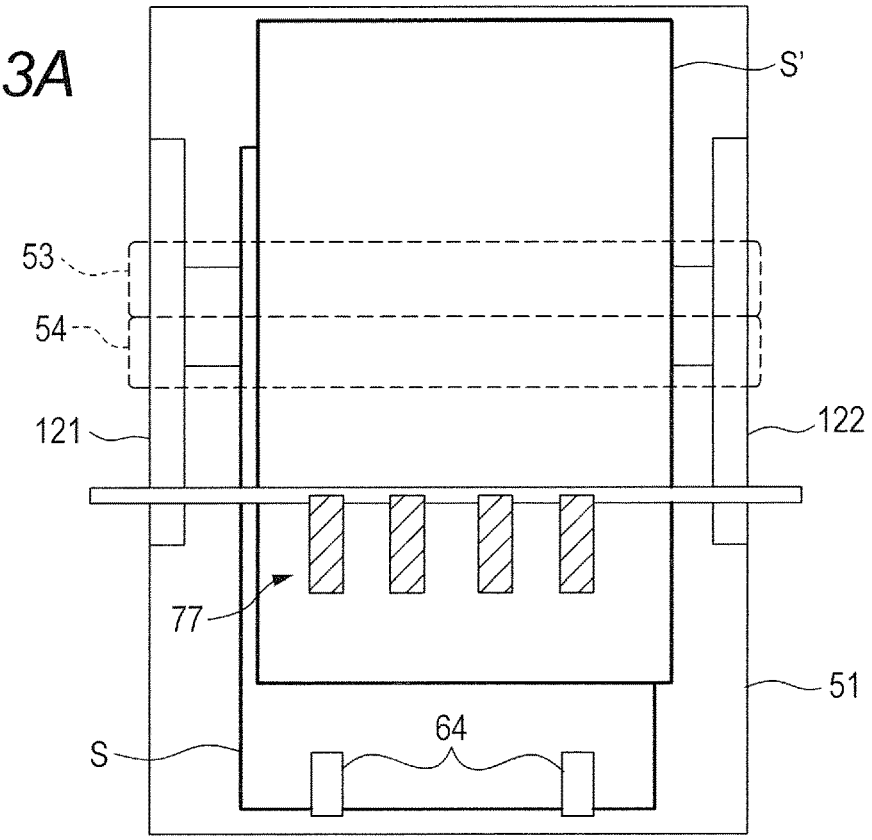
FIG. 13A is a view for schematically illustrating a state in which, in a case where sheets more than a predetermined number are conveyed to the sheet processing apparatus, a sheet subsequent to a preceding sheet is conveyed with deviation in a width direction.
Figure 13B:
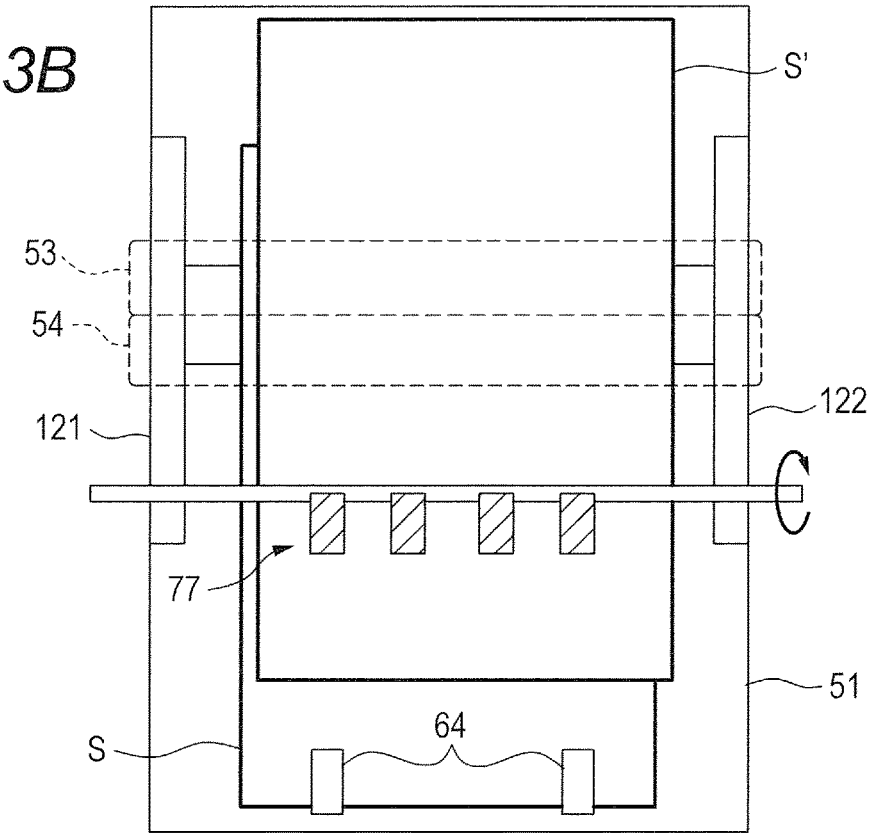
FIG. 13B is a view for schematically illustrating a state in which, in the case where the sheets more than the predetermined number are conveyed to the sheet processing apparatus, the sheet subsequent to the preceding sheet is conveyed with deviation in the width direction.

FIG. 13A and FIG. 13B are views for illustrating a case where, in the alignment operation, a sheet S' delivered through the second sheet delivery path 31 is conveyed with deviation in the width direction with respect to the sheet S having already been reached the regulating stoppers 64 and held thereat. When the sheet S' is conveyed (Step S117), and is placed on the placement portion as illustrated in FIG. 13A (Step S118), the paddles 77*a* of the paddle wheel 77 are rotated. With this, the sheet S' is taken in as illustrated in FIG. 13B (Step S119).

Figure 14:
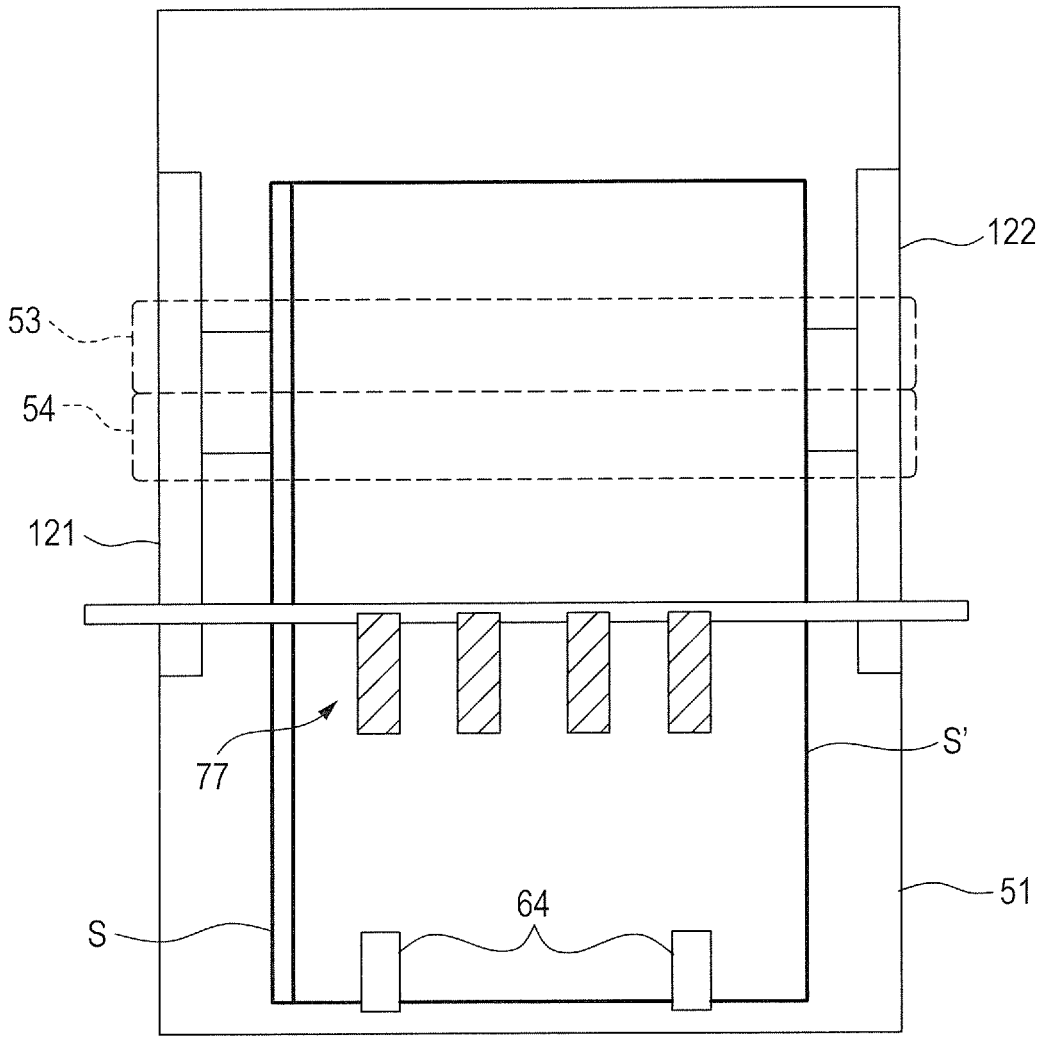
FIG. 14 is a view for schematically illustrating a state in which the subsequent sheet is held by the regulating stoppers with deviation with respect to the preceding sheet in the width direction.
Figure 15:
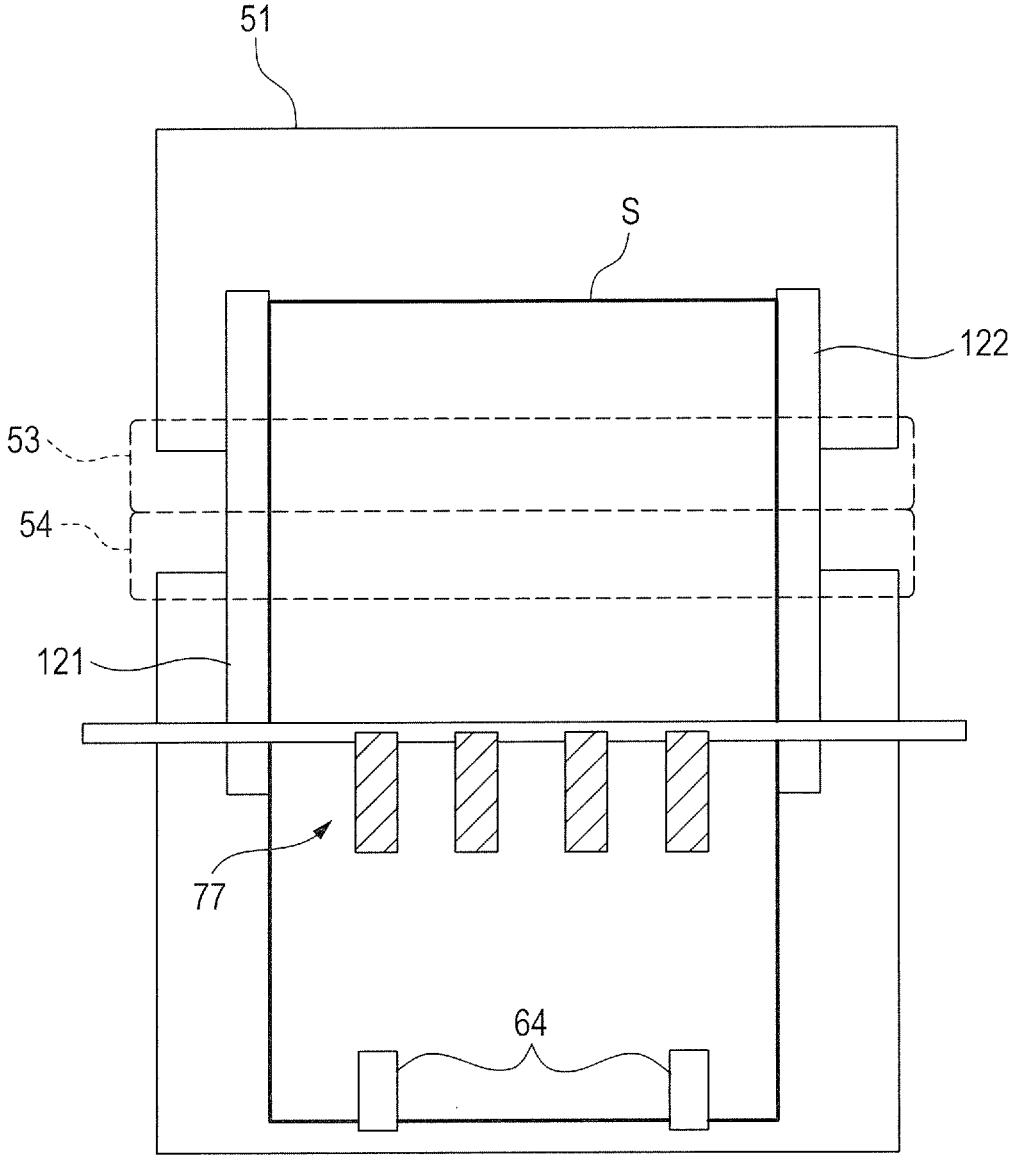
FIG. 15 is a view for schematically illustrating an operation of correcting the deviation of the subsequent sheet with respect to the preceding sheet.

Then, as illustrated in FIG. 14, when the sheet S' is held by the regulating stoppers 64 similarly to the sheet S, the deviation of the sheet S' with respect to the sheet S is corrected as illustrated in FIG. 15 through the alignment operation by the sheet side edge adjustment members 121 and 122 (Step S121).

Meanwhile, in a case where the high-accuracy folding processing is not instructed by the image formation controller 100 ("NO" in Step S120), the operations in Step S121 and Step S122 are not performed. At each time a sheet is delivered from the second sheet delivery path 31, the sheet is collected in the sheet stacking tray 51 without being adjusted in position through the alignment.

Figure 16:
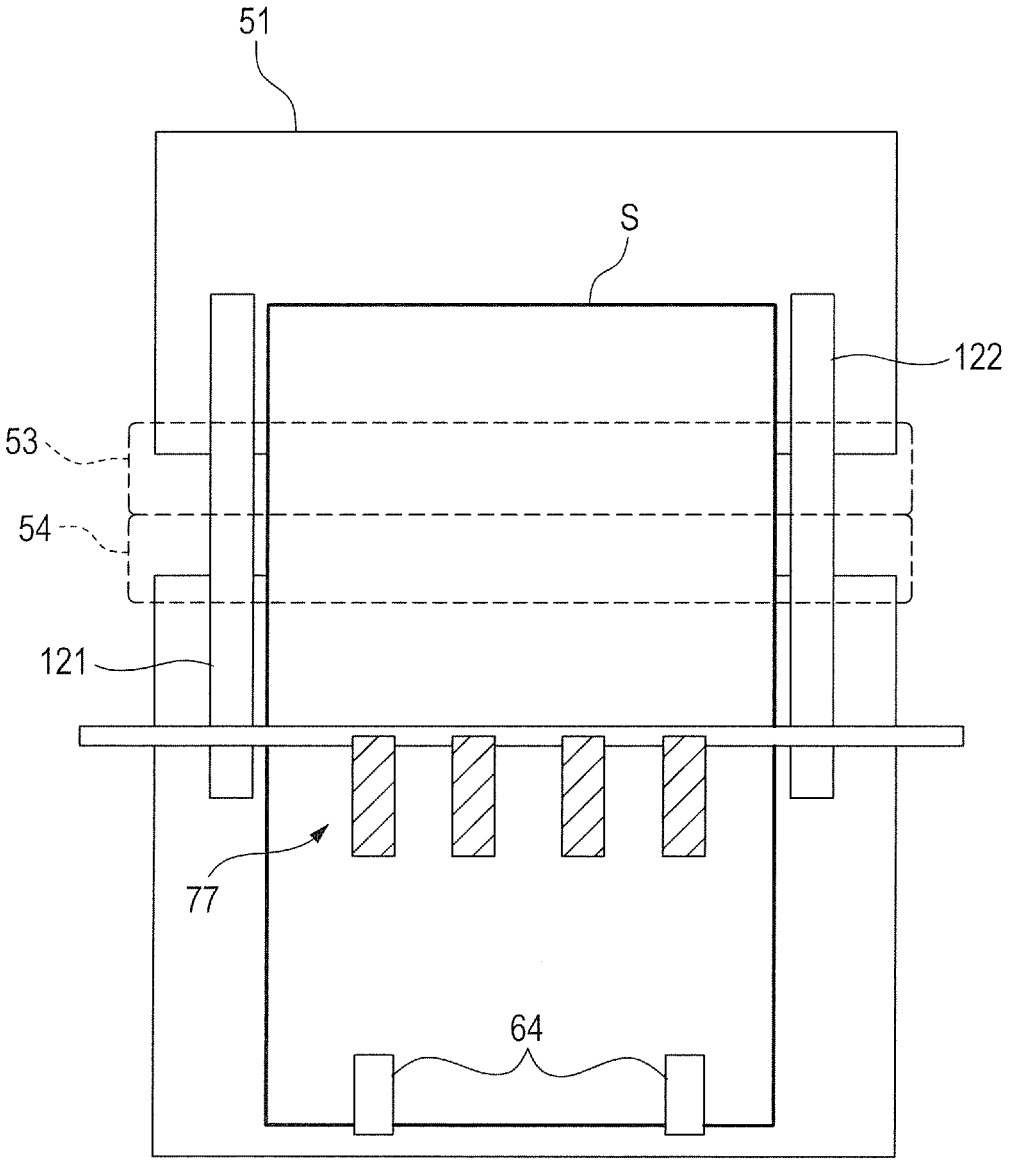
FIG. 16 is a view for schematically illustrating positions of sheet side edge adjustment members when the bundle of sheets held by the regulating stoppers is transferred to the folding processing position.

When all sheets S are introduced to the sheet stacking tray 51, the sheet side edge adjustment members 121 and 122 move toward both side edges of the bundle of sheets. In this case, as illustrated in FIG. 16, the sheet side edge adjustment members 121 and 122 approach the side edges while leaving slight gaps from the side edges rather than being brought into contact with the side edges (Step S124).

Figure 17A:
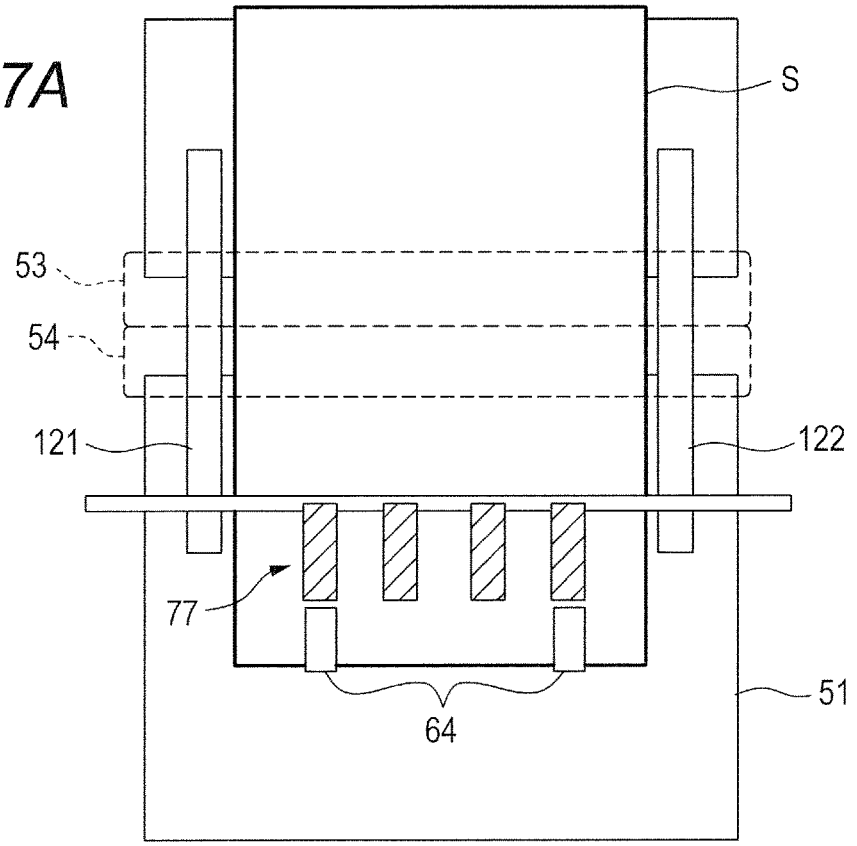
FIG. 17A is a view for schematically illustrating an operation of transferring the bundle of sheets held by the regulating stoppers to the folding processing position.

Then, through upward movement of the regulating stoppers 64, the bundle of sheets held by the regulating stoppers 64 is raised to the folding processing position at which the center portion of the bundle of sheets is opposed to the folding blade 56 of the folding processing device 41 as illustrated in FIG. 17A (Step S125). Even when deviation in the width direction occurs in the sheets of the bundle of sheets due to the raising operation at this time, the sheets are brought into contact with the sheet side edge adjustment members 121 and 122 which are positioned close to the side edges of the sheets. Thus, the deviation is corrected.

When the sheets are moved to the folding processing position, the sheet processing controller 200 determines whether or not the high-accuracy folding processing is instructed by the image formation controller 100 (Step S126). When the high-accuracy processing is instructed, the alignment operation is performed in Step S127. The alignment performed at this time is the operation after the bundle of sheets has been moved to the folding processing position. Thus, similarly to the alignment operation in Step S113, the position adjustment through alignment at the second adjustment position is performed.

Figure 17B:
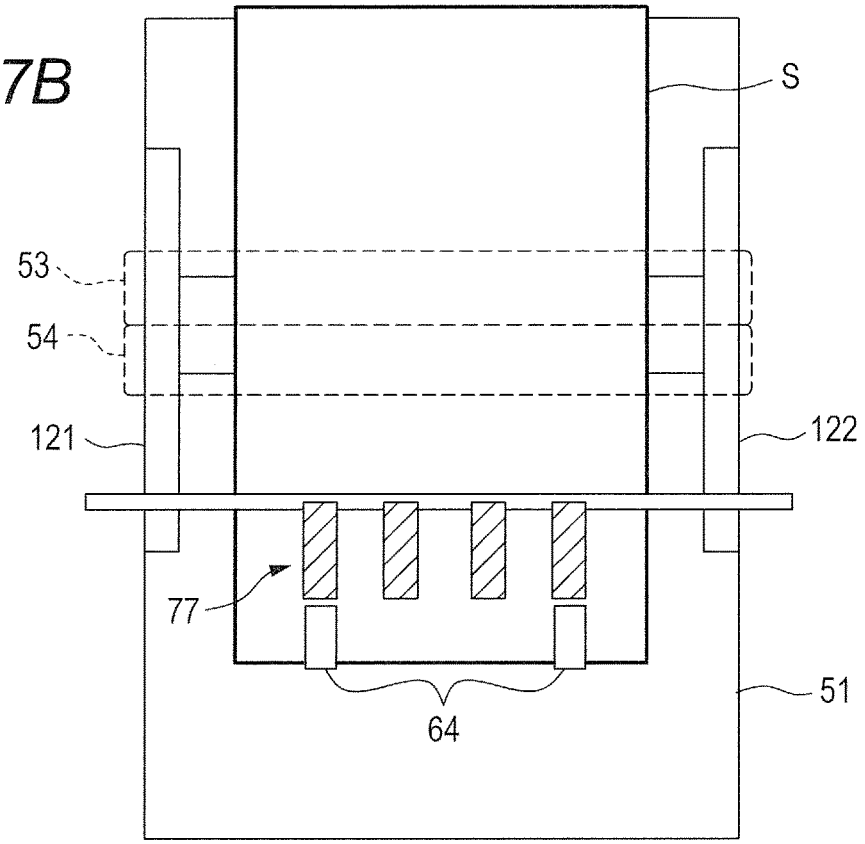
FIG. 17B is a view for illustrating a state in which folding processing is performed after the transfer to the folding processing position.

Then, as illustrated in FIG. 17B, the sheet side edge adjustment members 121 and 122 are retreated (Step S128).

Then, the folding blade 56 pushes the center portion of the bundle of sheets into the press-contact portion 55 of the folding rollers 53 and 54 to perform the folding processing (Step S129). After the folding processing is performed, the sheets are delivered to the stacking tray 44 (Step S130). Thus, all the operations of the image forming system 1000 are terminated.

In a case where the number of sheets S is equal to or larger than a predetermined number, and the high-accuracy processing is to be performed, the alignment operation at the first adjustment position is performed each time the sheet S is conveyed from the second sheet delivery path 31. After all the sheets S are held by the regulating stoppers 64, and also after the sheets S are raised to the folding processing position, the alignment operation is performed also at the second adjustment position. When a large number of sheets S equal to or larger than the predetermined number are moved, a sheet which is disturbed in posture is liable to be mixed. Therefore, the alignment is performed at both the first adjustment position and the second adjustment position to improve folding processing accuracy.

When the high-accuracy folding processing is not required, the position adjustment through alignment by the sheet side edge adjustment members 121 and 122 is not to be performed. However, the position adjustment in a direction along the end edge of the sheets is performed through the taking-in operation of the paddle wheel 77, and hence the folding processing accuracy is secured to some extent. Therefore, through omission of the alignment operation performed when the bundle of sheets is raised to the folding processing position, time for the folding processing may be shortened.

As described above in detail, the folding processing device 41 of the sheet processing apparatus B according to the present invention omits the position adjustment by the sheet side edge adjustment members 121 and 122 in accordance with the sheet size or required accuracy in folding processing.

That is, when the number of sheets is equal to or larger than a predetermined number, and the high-accuracy processing is required, the position adjustment at the first adjustment position by the sheet side edge adjustment members 121 and 122 is performed each time a sheet is held by the regulating stoppers 64. Further, after the position adjustment for the final sheet is performed, and the sheets are transferred by the regulating stoppers 64 to the folding processing position, the position adjustment is performed at the second adjustment position. In a case where the number of sheets is equal to or larger than a predetermined number, and the high-accuracy processing is not required, the position adjustment by the sheet side edge adjustment members 121 and 122 is omitted.

When the number of sheets is less than a predetermined number, irrespective of whether or not the high-accuracy processing is required, the sheets are transferred by the regulating stoppers 64 to the folding processing position, and the position adjustment by the sheet side edge adjustment members 121 and 122 at the second adjustment position is performed. However, in a case where the number of sheets is less than a predetermined number, and the sheets have a large sheet size, and in a case where the high-accuracy processing is not required, the position adjustment by the sheet side edge adjustment members 121 and 122 is omitted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-030757, filed Feb. 22, 2016, which is hereby incorporated by reference herein in its entirety.

What is claimed is:

1. A sheet processing apparatus comprising:

a conveying portion configured to convey a sheet;

a placement portion on which a sheet which has been conveyed by the conveying portion is placed;

a regulation portion configured to contact an edge of a sheet which has been placed on the placement portion, and to regulate a position of the sheet;

an alignment portion configured to perform an alignment operation on a sheet in a direction along the edge of the sheet;

a folding portion configured to perform folding processing on a sheet which has been regulated by the regulation portion; and a control portion configured to execute a first mode and a second mode, wherein in the first mode, (i) the control portion causes the conveying portion to convey a sheet to the placement portion, after which the edge of the sheet which has been placed on the placement portion contacts the regulation portion, and then the control portion causes the folding portion to perform the folding processing on the sheet which has contacted the regulation portion, and in the first mode, (ii) the control portion causes the alignment portion not to perform any alignment operation on the sheet, the edge of which has contacted the regulation portion, in a direction along the edge of the sheet, and wherein in the second mode, the control portion causes the conveying portion to convey a sheet to the placement portion, after which the edge of the sheet which has been placed on the placement portion contacts the regulation portion, and then the control portion causes the alignment portion to perform the alignment operation on the sheet, the edge of which has contacted the regulation portion, in a direction along the edge of the sheet.

2. A sheet processing apparatus according to claim 1, wherein, in the second mode, the control portion causes the folding portion to perform the folding processing on a sheet after the control portion causes the alignment portion to perform the alignment operation on the sheet, the edge of which has contacted the regulation portion, in a direction along the edge of the sheet.

3. A sheet processing apparatus according to claim 2, further comprising a moving portion configured to move a sheet which has contacted the regulation portion to a folding processing position at which the folding portion performs the folding processing on the sheet.

4. A sheet processing apparatus according to claim 3, wherein, in the second mode, the control portion (a) causes the moving portion to move a sheet to the folding processing position after the control portion causes the alignment portion to perform the alignment operation on the sheet, the edge of which has contacted the regulation portion, in a direction along the edge of the sheet and (b) the control portion causes the folding portion to perform the folding processing on the sheet after performing the alignment operation in the direction along the edge of the sheet by the alignment portion on the sheet which has been positioned at the folding processing position.

5. A sheet processing apparatus according to claim 3, wherein the control portion executes the second mode in a case where the control portion causes the moving portion to move the sheet upward so as to position the sheet at the folding processing position.

6. A sheet processing apparatus according to claim 3, wherein the control portion determines whether to cause the moving portion to move the sheet upward or the sheet downward in accordance with a length of the sheet in a moving direction in which the moving portion moves the sheet.

7. A sheet processing apparatus comprising:

a conveying portion configured to convey a sheet;

a placement portion on which a sheet which has been conveyed by the conveying portion is placed;

a regulation portion configured to contact an edge of a sheet which has been placed on the placement portion and to regulate a position of the sheet;

an alignment portion configured to perform an alignment operation on a sheet in a direction along the edge of the sheet;

a folding portion configured to perform folding processing on a sheet positioned at a folding processing position;

a moving portion configured to move a sheet which has been regulated by the regulation portion, to the folding processing position; and a control portion configured to execute a first mode and a second mode, wherein in the first mode, (i) the control portion causes the conveying portion to convey a sheet to the placement portion, after which the edge of the sheet which has been placed on the placement portion contacts the regulation portion, then the control portion causes the moving portion to position the sheet, the edge of which has contacted the regulation portion, at the folding processing position, and then the control portion causes the folding portion to perform the folding processing on the sheet which has been positioned at the folding processing position by the moving portion, and in the first mode, (ii) the control portion causes the alignment portion not to perform any alignment operation on the sheet, the edge of which has contacted the regulation portion, before the control portion causes the moving portion to position the sheet at the folding processing position, and wherein in the second mode, the control portion causes the conveying portion to convey a sheet to the placement portion, after which the edge of the sheet which has been placed on the placement portion contacts the regulation portion, then the control portion causes the alignment portion to perform the alignment operation on the sheet, the edge of which has contacted the regulation portion, in a direction along the edge of the sheet, then the control portion causes the moving portion to position the sheet, the edge of which has contacted the regulation portion, at the folding processing position, and then the control portion causes the folding portion to perform the folding processing on the sheet which has been positioned at the folding processing position by the moving portion.

* * * * *